US008697978B2

(12) United States Patent
Kulkarni et al.

(10) Patent No.: US 8,697,978 B2
(45) Date of Patent: Apr. 15, 2014

(54) SYSTEMS AND METHODS FOR PROVIDING MULTI-REGION INSTRUMENT SUPPORT IN AN AUDIO PLAYER

(75) Inventors: Prajakt Kulkarni, San Diego, CA (US); Suresh Devalapalli, San Diego, CA (US)

(73) Assignee: QUALCOMM Incorporated, San Diego, CA (US), 3

( * ) Notice: Subject to any disclaimer, the term of this patent is extended or adjusted under 35 U.S.C. 154(b) by 90 days.

(21) Appl. No.: 12/358,037

(22) Filed: Jan. 22, 2009

(65) Prior Publication Data

US 2009/0205481 A1 Aug. 20, 2009

Related U.S. Application Data

(60) Provisional application No. 61/023,174, filed on Jan. 24, 2008.

(51) Int. Cl.
*G10H 7/00* (2006.01)

(52) U.S. Cl.
USPC ..... 84/645; 84/634; 84/666

(58) Field of Classification Search
USPC ..... 84/645
See application file for complete search history.

(56) References Cited

U.S. PATENT DOCUMENTS 5,206,446 A * 4/1993 Matsumoto et al. ..... 84/624
5,331,111 A * 7/1994 O'Connell ..... 84/602
5,496,963 A 3/1996 Ito
5,637,822 A 6/1997 Utsumi et al.
5,686,682 A 11/1997 Ohshima et al.
5,847,302 A 12/1998 Morikawa et al.
5,852,251 A 12/1998 Su et al.
5,864,080 A 1/1999 O'Connell
5,864,081 A * 1/1999 Iwase et al. ..... 84/622
6,201,178 B1 3/2001 Shinsky
6,274,799 B1 8/2001 Shimizu
6,372,973 B1 4/2002 Schneider
6,462,264 B1 10/2002 Elam
7,045,700 B2 * 5/2006 Hamalainen et al. ..... 84/645
7,112,737 B2 * 9/2006 Ramstein ..... 84/645
7,205,470 B2 4/2007 Tsukamoto et al.

(Continued)

FOREIGN PATENT DOCUMENTS

EP 0484043 5/1992
EP 1662821 A1 5/2006

(Continued)

OTHER PUBLICATIONS

International Search Report and Written Opinion—PCT/US2009/031931, International Search Authority—European Patent Office—May 7, 2009.

(Continued)

*Primary Examiner* — Christopher Uhlir
(74) *Attorney, Agent, or Firm* — Espartaco Diaz Hidalgo

(57) ABSTRACT

A method for providing multi-region instrument support in an audio player is described. A set of user defined instruments and a set of MIDI data is received. At least one multi-region instrument in the set of user defined instruments is identified. Each region in the multi-region instruments is mapped to a single region instrument with the same parameters as the region. A new instrument number is assigned to each single region instrument. The MIDI data is modified based on the mapping and assigning.

33 Claims, 18 Drawing Sheets

(56) References Cited

U.S. PATENT DOCUMENTS

| | | | | |
|---|---|---|---|---|
| 7,518,056 | B2 | 4/2009 | Lechner | |
| 7,880,078 | B2 * | 2/2011 | Nishida | 84/615 |
| 8,030,568 | B2 | 10/2011 | Kulkarni et al. | |
| 2002/0139238 | A1 * | 10/2002 | Mukaino et al. | 84/622 |
| 2004/0173084 | A1 | 9/2004 | Tomizawa et al. | |
| 2004/0231500 | A1 | 11/2004 | Sim et al. | |
| 2004/0267541 | A1 | 12/2004 | Hamalainen | |
| 2005/0015258 | A1 | 1/2005 | Somani et al. | |
| 2005/0211075 | A1 | 9/2005 | Desai et al. | |
| 2005/0211076 | A1 * | 9/2005 | Park et al. | 84/645 |
| 2006/0027078 | A1 | 2/2006 | Kawashima | |
| 2006/0101978 | A1 | 5/2006 | Honeywell et al. | |
| 2006/0112815 | A1 | 6/2006 | Sant | |
| 2006/0123979 | A1 | 6/2006 | Park et al. | |
| 2006/0207412 | A1 | 9/2006 | Okamoto et al. | |
| 2009/0205480 | A1 | 8/2009 | Kulkarni et al. | |

FOREIGN PATENT DOCUMENTS

| | | | |
|---|---|---|---|
| JP | 61045298 | A | 3/1986 |
| JP | 8083075 | A | 3/1996 |
| JP | 9292883 | A | 11/1997 |
| JP | 11126079 | A | 5/1999 |
| JP | 2001100744 | A | 4/2001 |
| JP | 2002258841 | | 9/2002 |
| JP | 2003263159 | A | 9/2003 |
| JP | 2004157295 | A | 6/2004 |
| JP | 2005338126 | A | 12/2005 |
| TW | 200739412 | | 10/2007 |
| WO | WO97007476 | | 2/1997 |

OTHER PUBLICATIONS

Taiwan Search Report—TW098103162—TIPO—Nov. 6, 2012.

* cited by examiner

SYSTEMS AND METHODS FOR PROVIDING MULTI-REGION INSTRUMENT SUPPORT IN AN AUDIO PLAYER

RELATED APPLICATIONS

This application is related to and claims priority from U.S. Provisional Patent Application Ser. No. 61/023,174 filed Jan. 24, 2008, for "Techniques to Improve the Similarity of the Output Sound Between Audio Players," with inventors Prajakt Kulkami and Suresh Devalapalli.

TECHNICAL FIELD

The present disclosure relates to digital audio. Specifically, the present disclosure relates to providing multi-region instrument support in a MIDI audio player.

BACKGROUND

The Musical Instrument Digital Interface (MIDI) format is used in the creation, communication and/or playback of audio sounds, such as music, speech, tones, alerts, and the like. MIDI is supported in a wide variety of devices. For example, wireless communication devices, such as radiotelephones, may support MIDI files for downloadable sounds such as ringtones or other audio output. Digital music players, such as the "iPod" devices sold by Apple Computer, Inc and the "Zune" devices sold by Microsoft Corporation may also support MIDI file formats. Other devices that support the MIDI format may include various music synthesizers, wireless mobile devices, direct two-way communication devices (sometimes called walkie-talkies), network telephones, personal computers, desktop and laptop computers, workstations, satellite radio devices, intercom devices, radio broadcasting devices, hand-held gaming devices, circuit boards installed in devices, information kiosks, video game consoles, various computerized toys for children, on-board computers used in automobiles, watercraft and aircraft, and a wide variety of other devices.

MIDI files may include information about musical notes to be played on a MIDI player. However, MIDI players may also use player-specific parameters to play MIDI files. Thus, the same MIDI file may not sound identical when played in two different MIDI players. Possible reasons for this may be the lack of multi-region instrument support or variable root note support. Therefore, there is a need for techniques for providing multi-region instrument support in an audio player.

DETAILED DESCRIPTION

Figure 1:
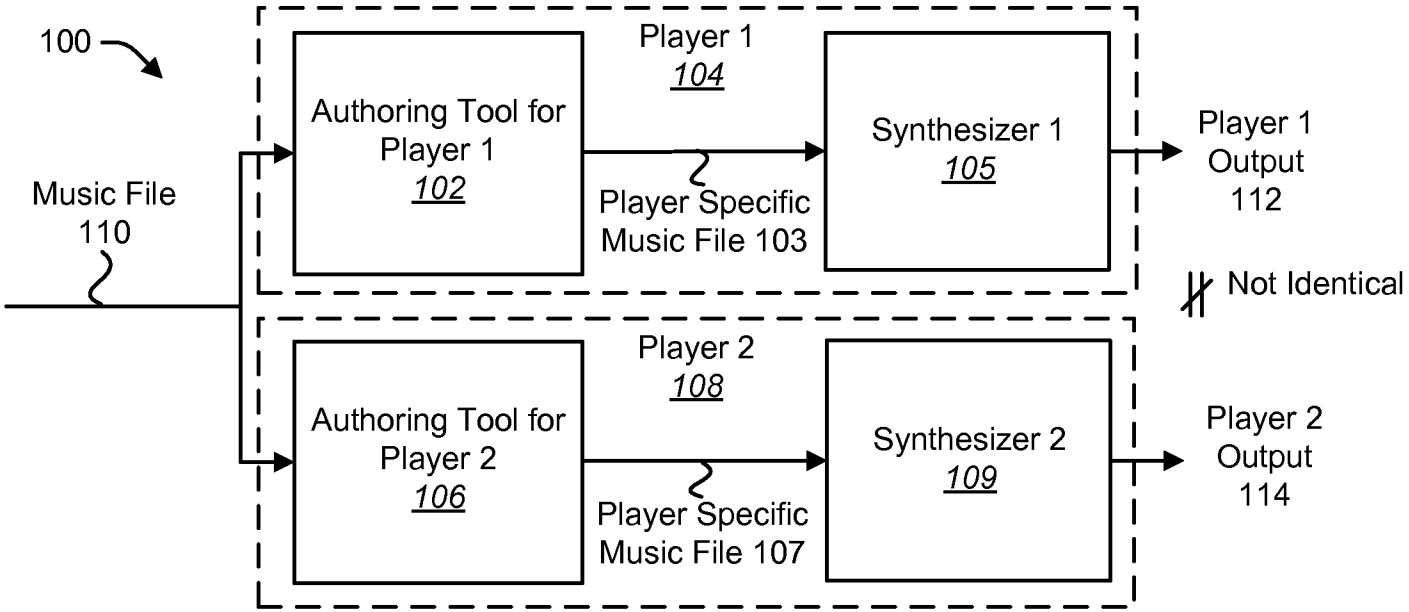
FIG. 1 is a block diagram illustrating a system that may be modified with the present systems and methods.

A method for providing multi-region instrument support in an audio player is disclosed. A set of user defined instruments and a set of Musical Instrument Digital Interface (MIDI) data is received. At least one multi-region instrument in the set of user defined instruments is identified. Each region in the multi-region instruments is mapped to a single region instrument with the same parameters as the region. A new instrument number is assigned to each single region instrument. The MIDI data is modified based on the mapping and assigning.

An apparatus for providing multi-region instrument support in an audio player is also disclosed. The apparatus includes a processor and memory in electronic communication with the processor. Executable instructions are stored in the memory. The instructions are executable to receive a set of user defined instruments and a set of Musical Instrument Digital Interface (MIDI) data. The instructions may also be executable to identify at least one multi-region instrument in the set of user defined instruments. The instructions are executable to map each region in the multi-region instruments to a single region instrument with the same parameters as the region. The instructions may further be executable to assign a new instrument number to each single region instrument. The instructions are further executable to modify the MIDI data based on the mapping and assigning.

A computer-program product for providing multi-region instrument support in an audio player is also disclosed. The computer-program product comprises a computer-readable medium having instructions thereon. The instructions may include code for receiving a set of user defined instruments and a set of MIDI data. The instructions may also include code for identifying at least one multi-region instrument in the set of user defined instruments. The instructions may also include code for mapping each region in the multi-region instruments to a single region instrument with the same parameters as the region. The instructions may also include code for assigning a new instrument number to each single region instrument. The instructions may also include code for modifying the MIDI data based on the mapping and assigning.

An apparatus for providing multi-region instrument support in an audio player is also disclosed. The apparatus may include means for receiving a set of user defined instruments and a set of MIDI data. The apparatus may also include means for identifying at least one multi-region instrument in the set of user defined instruments. The apparatus may also include means for mapping each region in the multi-region instruments to a single region instrument with the same parameters as the region. The apparatus may also include means for assigning a new instrument number to each single region instrument. The apparatus may also include means for modifying the MIDI data based on the mapping and assigning.

An integrated circuit for providing multi-region instrument support in an audio player is also disclosed. The integrated circuit may be configured to receive a set of user defined instruments and a set of Musical Instrument Digital Interface (MIDI) data. The integrated circuit may also be configured to identify at least one multi-region instrument in the set of user defined instruments. The integrated circuit may also be configured to map each region in the multi-region instruments to a single region instrument with the same parameters as the region. The integrated circuit may also be configured to assign a new instrument number to each single region instrument. The integrated circuit may also be configured to modify the MIDI data based on the mapping and assigning.

A musical instrument digital interface (MIDI) player may take a MIDI file as input and synthesize the music as output. In doing so, a MIDI player may employ different techniques of synthesizing. Two of these synthesizing techniques include frequency modulation (FM) synthesis and wave table synthesis. A MIDI file may include messages describing the key number for notes to be played, the instrument to use when playing the notes, a note velocity, etc. Unlike some non-MIDI music decoders, a MIDI synthesizer may not decode a waveform describing the intended sound. Instead, each MIDI synthesizer may use synthesizer-specific tools to generate an output signal based on the messages in the MIDI file. Hence the same MIDI file may sound different when played through two different MIDI players. As used herein, the terms "key number" and "note number" may be used interchangeably, and are used to denote data that identifies the pitch of a MIDI note.

To mitigate some of these inconsistency problems, the MIDI Manufacturers Association (MMA) introduced the concept of Downloadable Sounds (DLS). DLS specifies how MIDI instruments should sound and includes all the parameters required for synthesizing the instruments.

According to the DLS standard, each instrument may be split into regions. A region may represent a set of notes on the instrument. An instrument may have only one region that covers the entire MIDI note range of 0 through 127, or it may have multiple regions that each cover a subset of the entire range. For example, the piano instrument may be defined in a DLS file as having a first region covering notes 0 through 30, a second region covering notes 31 through 120, and a third region covering notes 121 through 127. The DLS file may define a root note and a waveform for each region. The root note may be the note with which the unmodified waveform is associated. In other words, if the root note is selected to be played, a player may output the waveform associated with the region without any pitch modifications. If a non-root note is selected to be played, however, the pitch of the waveform may be changed to achieve the desired output. There may also be modulation or other non-pitch modifications to the waveform, even for root notes. For example the waveform may be resampled to account for different sampling frequencies.

FIG. 1 is a block diagram illustrating a system 100 that may be modified with the present systems and methods. As used herein, the term "music file" refers to any audio data or file that includes at least one audio track that conforms to the MIDI format and user defined instrument data. File formats that may conform to the MIDI format and may be in the music file 110 include compact media extensions (CMX) developed by Qualcomm, Inc., synthetic music mobile application format (SMAF) developed by Yamaha Corp., and scalable polyphony MIDI (SP-MIDI). The user defined instrument data in the music file 110 may be a DLS file that includes instrument information. For example, the music file 110 may be an eXtensible Music Format (XMF) file that includes a DLS and a MIDI file.

Since MIDI is a message-based protocol, each audio player 104, 108 may use unique file format support to play music files 110. This file format support may include one or more files used to produce an output based on the MIDI messages in the music file 110 and may reside in a separate authoring tool 102, 106. In other words, the first authoring tool 102 may include file format support that the first synthesizer 105 may use to play the music file 110. Likewise, the second authoring tool 106 may include file format support that the second synthesizer 109 may use to play the music file 110. Additionally, the first authoring tool 102 may convert the music file 110 into a first player specific format 103 and the second authoring tool 106 may convert the music file 110 into a second player specific format 107. Since the first authoring tool 102 may be different than the second authoring tool 106, the first player output 112 may differ from the second player output 114. Specifically, the differences between the first player output 112 and the second player output 114 may be attributed to the following: (1) the MIDI protocol only specifies notes to be played, instruments to use when playing notes, modulations on the notes, etc., however, MIDI does not specify exactly how the notes should sound when played; (2) different players may use different techniques for synthesis; and (3) even for the same synthesis technique different audio players may model the same instrument differently. For example, a MIDI-synthesized piano may sound like a real acoustic grand piano in a high end audio player, but may sound like a trumpet in a low quality audio player.

Additionally, several differences may be observed, even when the same music file 110 is played on different players 104, 108. First, the instrument volume mixing in the players 104, 108 may be different. For example, if a music file 110 includes MIDI notes played by a piano and a flute, the piano notes may be played at higher volume than the flute notes in the first player 104 while the flute notes may be played at higher volume than piano in the second player 108. Additionally, the vibrato and tremolo effects on instruments may be different depending on the way the instruments are modeled in the different players 104, 108. Additionally still, some players 104, 108 may ignore notes higher or lower than a defined range.

Despite these differences, the present systems and methods, described below, may be implemented in the system 100 to generate similar output in the different audio players 104, 108. In other words, the first player output 112 may be similar to the second player output 114 when implementing the present systems and methods.

Figure 2:
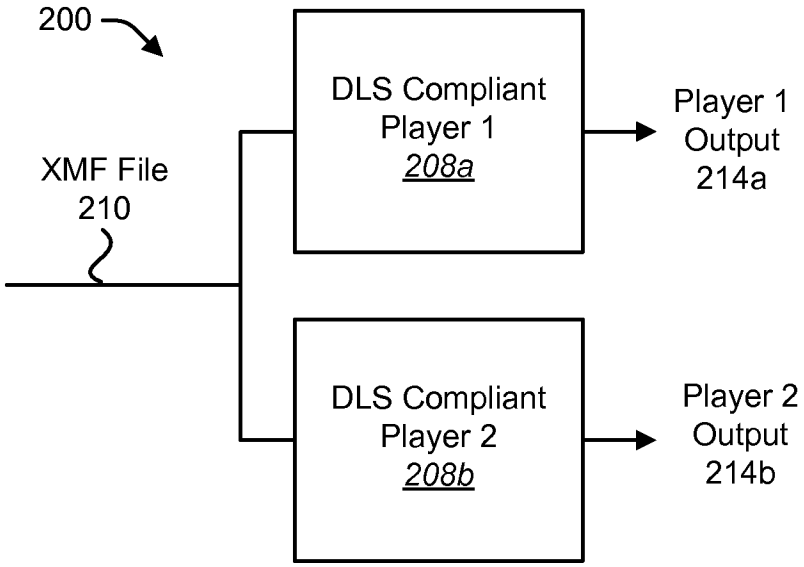
FIG. 2 is a block diagram illustrating a system that may be modified according to the present systems and methods, and still maintain similar outputs.

FIG. 2 is a block diagram illustrating a system 200 that may be modified according to the present systems and methods, and still maintain similar outputs. The music file coming into the system 200 may be an XMF file 210 that includes a DLS file and a MIDI file. The XMF file 210 may produce similar outputs 214 even when played on different DLS compliant players 208 because DLS instrument parameters may be mapped to player-specific instrument parameters.

However, the DLS standard, as used in the XMF file 210, may be supported only in limited capacity in most of the synthesizers that support Wave Table synthesis. When played through a non-DLS compliant player, the output may not sound similar for the following reasons. First, DLS allows a user to define any note for an instrument as the root note for that region. A non-DLS player may not allow this, but rather fix the root note. Since the root note may be used to identify a reference waveform, using a fixed root note in a non-DLS player rather than one specified in an input DLS file may cause an output to sound different than intended. Second, a non-DLS player may not support multiple regions within a single instrument. When a note using a multi-region instrument is played, a non-DLS player may simply ignore the note or assign an incorrect region, causing inconsistencies based on player design. Third, there may be limited, inconsistent range support in non-DLS players.

The systems and methods described herein may provide for similar output in different players, even when one of the players is not a DLS compliant player 208. This may be done using a conversion module that alters the XMF file 210. For example, the systems and methods may produce similar output across Qualcomm's CMX (Compact Media eXtension) player and Yamaha's SMAF (Synthetic Music Mobile Application Format) player. Given an XMF file 210 in this example, a conversion module may map the multi-region instruments into single region instruments and/or modify one or more notes in the XMF file 210 to create a new music file, such as a SMAF file. After these modifications to the XMF file 210, the new music file may produce a similar output when played through a non-DLS player, such as a SMAF player, as the output of the CMX player playing the XMF file 210.

Figure 3:
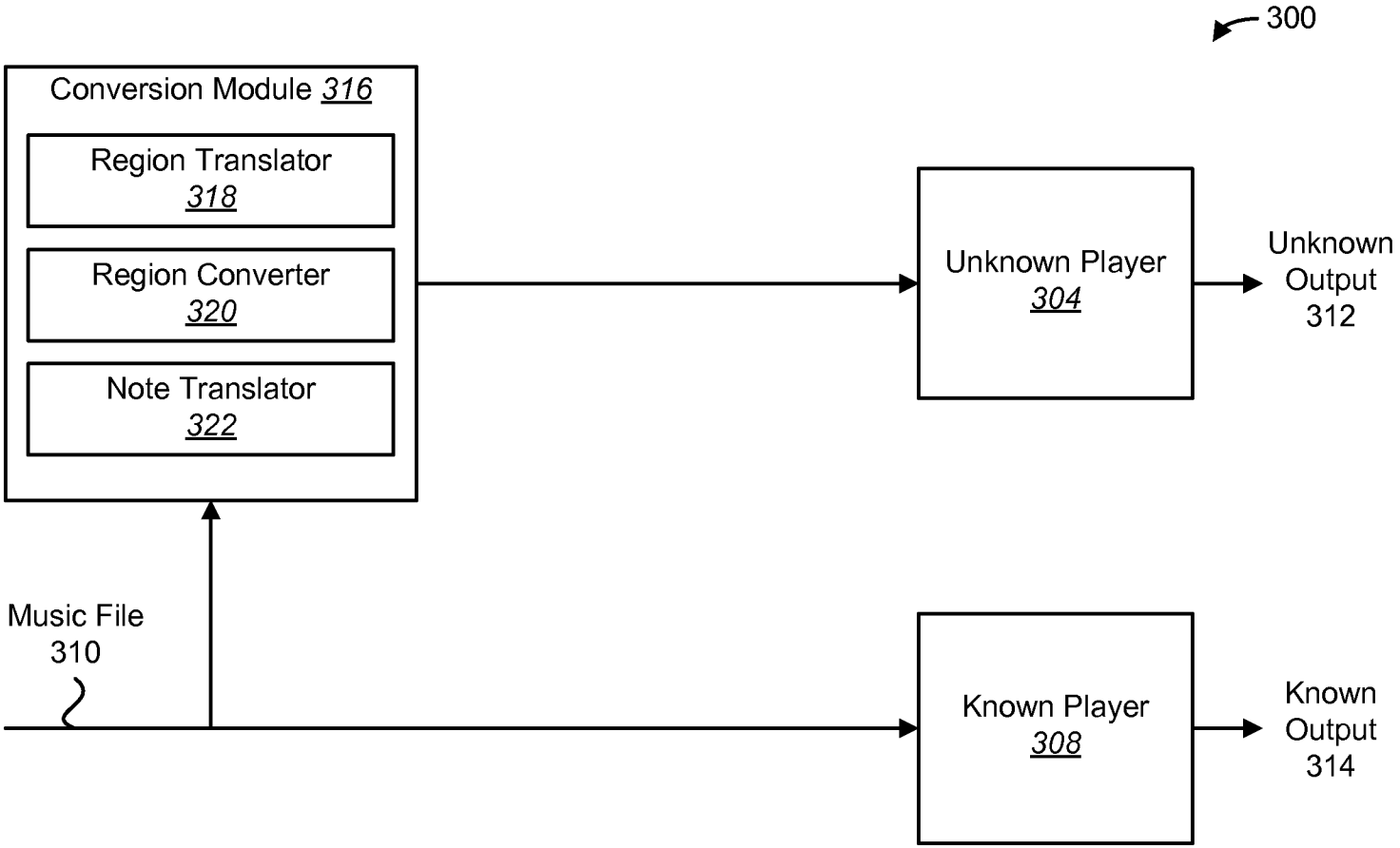
FIG. 3 is a block diagram illustrating a system for providing multi-region instrument support and variable root note support in an audio player.

FIG. 3 is a block diagram illustrating a system 300 for providing multi-region instrument support and variable root note support in an audio player. The system 300 may include a conversion module 316, an unknown audio player 304, and a known audio player 308. As used herein, the term "unknown player" refers to an audio player, a synthesizer, or both, for which one or more synthesizing parameters and/or logic are unknown to the conversion module 316. For example, the unknown player 304 may interpret multi-region instruments and user-defined root notes in ways unknown to the conversion module 316. As a result, the unknown player output 312 may be unpredictable and dissimilar to the known player output 314. In contrast, the term "known player" may refer to an audio player, a synthesizer, or both, for which the synthesizing parameters and logic are known to the conversion module 316. For example, the known player 308 may support multi-region instruments and variable root notes. Therefore, the known output 314 may be more predictable than the unknown output 312 because the unknown player 304 may use unknown internal logic to deal with multi-region instruments and variable root notes. In other words, the conversion module 316 may make the unknown output 312 similar to the known output 314 when it may not have otherwise been similar.

The conversion module 316 may receive the music file 310 or a portion of the music file 310 and adjust the music file 310 so that the unknown output 312 is similar to the known output 314. For example, the conversion module 316 may map the multi-region instruments in the music file 310 into single region instruments that may be played correctly in the unknown player 304. Alternatively, or in addition, the conversion module 316 may adjust the note key numbers in the music file 310 based on the differences in the variable root notes in the music file 310 and the fixed root note in the unknown player 304. These modifications may make the unknown output 312 similar to the known output 314.

The conversion module 316 may receive MIDI notes, adjust MIDI note key numbers and/or instrument numbers, and send the notes to the unknown player 304 on a note-by-note basis. Alternatively, the conversion module 316 may receive the music file 310 as a whole, adjust all the notes in the music file 310, and then produce a new music file (not shown) that reflects the changes to the MIDI notes. Producing the new music file (not shown) may include rewriting the adjusted parameters in the music file 310. For example, the conversion module 316 may receive the music file 310, adjust the key numbers and instrument numbers in the music file 310, and create a new music file that may be used by the unknown player 304 to produce the unknown player output 312. The new music file may include user defined instruments, such as a DSL file. The MIDI portion of the new music file may be a SMAF file or a different type of MIDI file such as standard MIDI file (SMF), CMX, or SP-MIDI. For example, the new music file may include a SMAF file that includes graphics and pulse code modulation (PCM) support, which may not be included in the MIDI portion of the music file 310.

The conversion module 316 may include a region translator 318, a region converter 320, and a note translator 322. These three modules may combine to implement the present systems and methods and may operate together or independently. In other words, all three may not be needed for the conversion module 316 to operate. The region converter 320 may map the multi-region instruments in the music file 310 into single region instruments with the same parameters as the regions from which they were mapped. The region translator 318 may use these single region instruments to adjust the MIDI notes in the music file 310 so that the unknown player 304 that does not support multi-region instruments may still play the music file 310 with multi-region instruments correctly. Additionally, the note translator 322 may enable the unknown player 304 with a fixed root note to play the music file 310 with variable root notes correctly.

Figure 3A:
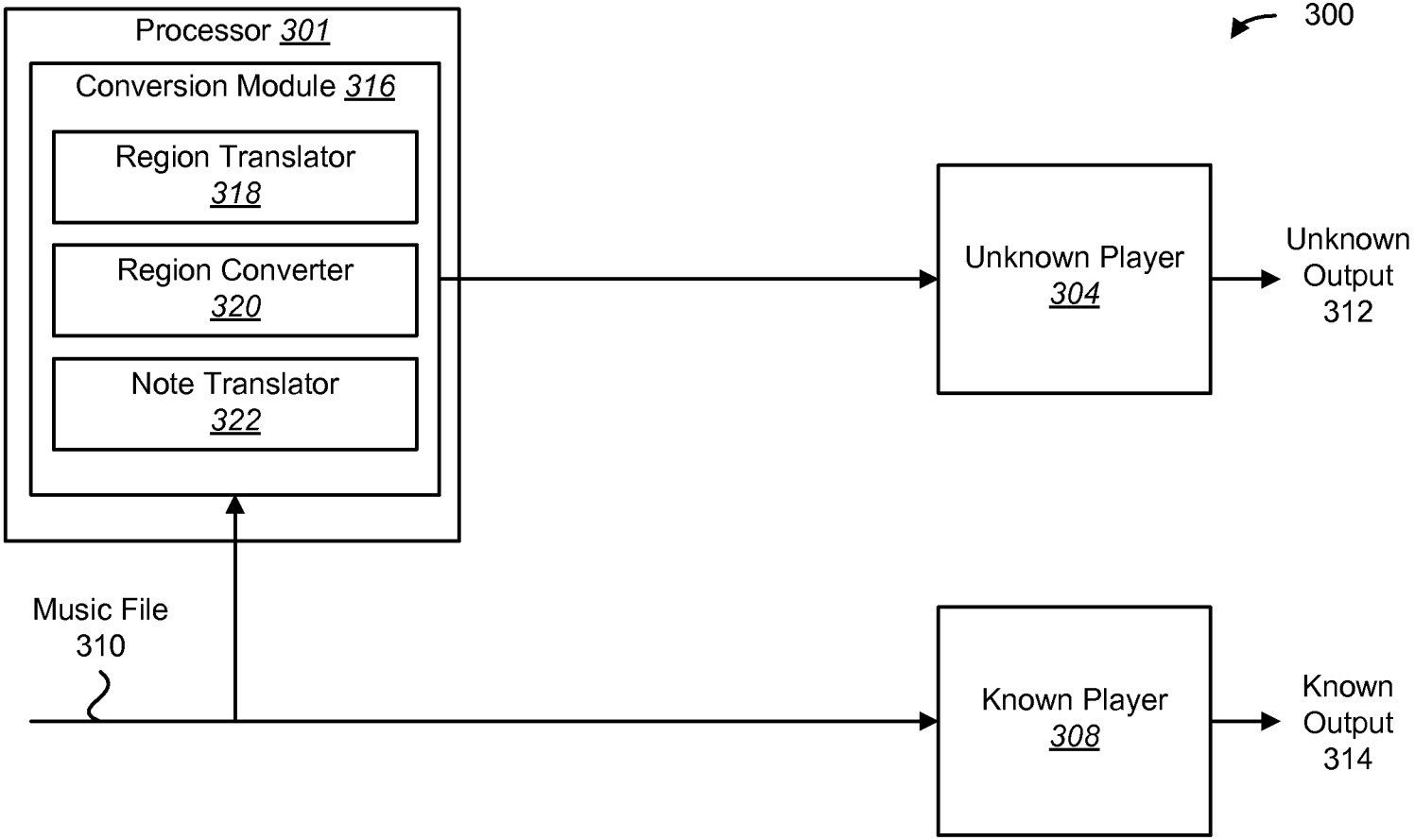
FIG. 3A is a block diagram illustrating that the conversion module in the system of FIG. 3 may be implemented by a processor.
Figure 3B:
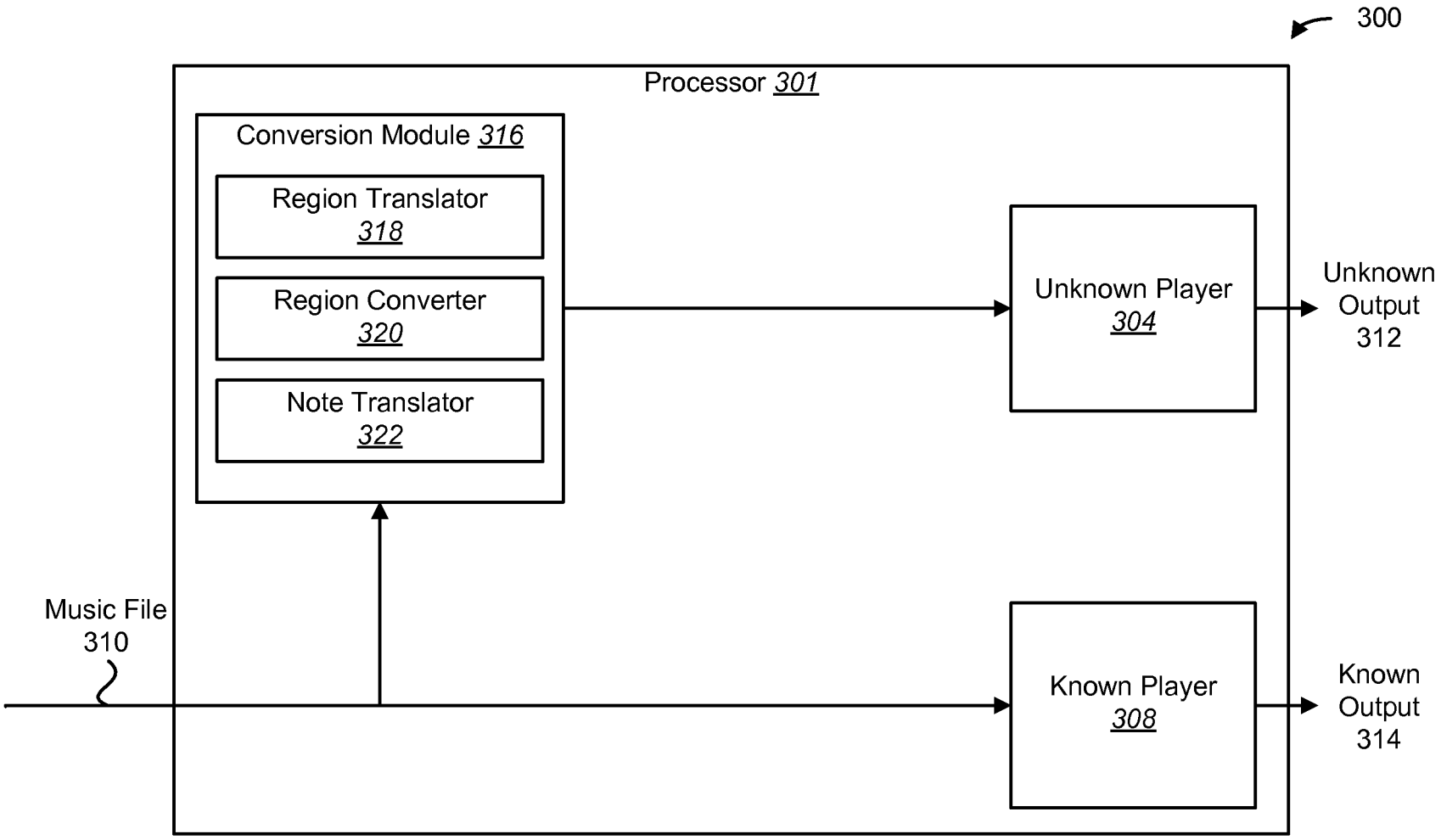
FIG. 3B is a block diagram illustrating that the conversion module, unknown player, and known player in the system of FIG. 3 may be implemented by a processor.

As shown in FIG. 3A, the conversion module 316 may be implemented by a processor 301. As shown in FIG. 3B, the conversion module 316, unknown player 304, and known player 308 may be implemented by a processor 301. Different processors may be used to implement different components (e.g., one processor may implement the conversion module 316, another processor may be used to implement the unknown player 304, and yet another processor may be used to implement the known player 308).

Figure 4:
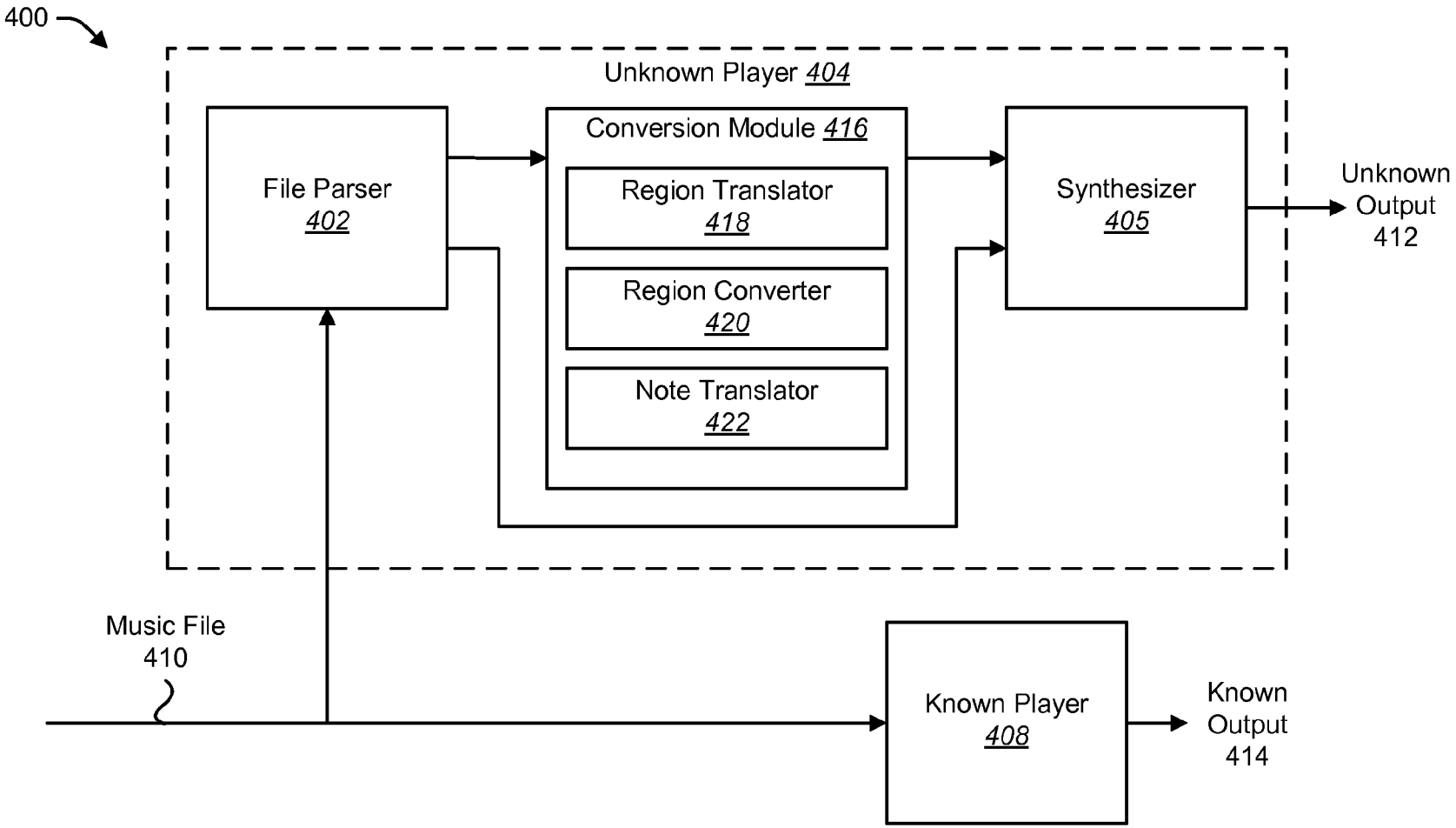
FIG. 4 is a block diagram illustrating another configuration of a system for providing multi-region instrument support and variable root note support in an audio player.

FIG. 4 is a block diagram illustrating another configuration of a system 400 for providing multi-region instrument support and variable root note support in an audio player. The system 400 may include an unknown player 404 and a known player 408. For example, the unknown player 404 may be a player that supports only single region instruments and a fixed root note for each instrument. The known player 408 may support multi-region instruments and variable root notes. Thus, without the conversion module 416, the unknown output 412 may not be similar to the known output 414.

The unknown player 404 may include a file parser 402. The file parser 402 may correspond to the music file 410. For example, if the music file 410 is an XMF file, the file parser 402 may be an XMF parser. The file parser 402 may convert the music file 410 into player-specific data. For example, if the unknown player 404 was a SMAF player, the file parser 402 may convert the music file 410 into, among other things, the SMAF format. Also, the file parser 402 may inform the conversion module 416 of relevant parameters in the synthesizer 405. For example, the parser 402 may tell the conversion module 416 that the synthesizer 405 only supports a fixed root note or that the synthesizer 405 does not support multi-region instruments.

The conversion module 416 may use, among other data, information from the file parser 402 to modify the music file 410 in order to create similar output from the unknown player 404 and the known player 408. This may include modifying the music file 410 so that the unknown player 404 plays notes using multi-region instruments correctly. To do this, the region converter 420 may map all the multi-region instruments in the music file 410 into single region instruments. The region translator 418 may then adjust the MIDI data in the music file 410 so that the single region instruments are played rather than the unsupported multi-region instruments. This may include inserting one or more program change commands in the music file 410. By doing this, notes using multi-region instruments may play correctly on the unknown player 404 that may not otherwise support multi-region instruments.

Additionally, the conversion module 416 may provide variable root note support in the unknown player 404 that may not otherwise support variable root notes. This may include modifying the music file 410 so that the unknown player 404 correctly plays notes using user-defined root notes. To do this, the note translator may determine the difference between the fixed root note supported by the synthesizer 405 and the root note in the instrument region used in each MIDI note. The note translator 422 may then adjust each MIDI note in the music file 410 by the same difference so that the unknown player 404 plays the music file 410 with variable root notes correctly. The synthesizer 405 may take MIDI notes as input and produce an output waveform.

While the conversion module 416 may provide both multi-region support and/or variable root note support to the unknown player 404, it should be noted that only part of the conversion module 416 may be implemented. In other words, if the unknown player 404 supported variable root notes, but not multi-region instruments, the conversion module 416 may not include the note translator 422. Likewise, if the unknown player 404 supported multi-region instruments, but not variable root notes, the conversion module 416 may not include the region translator 418 and the region converter 420.

Figure 5:
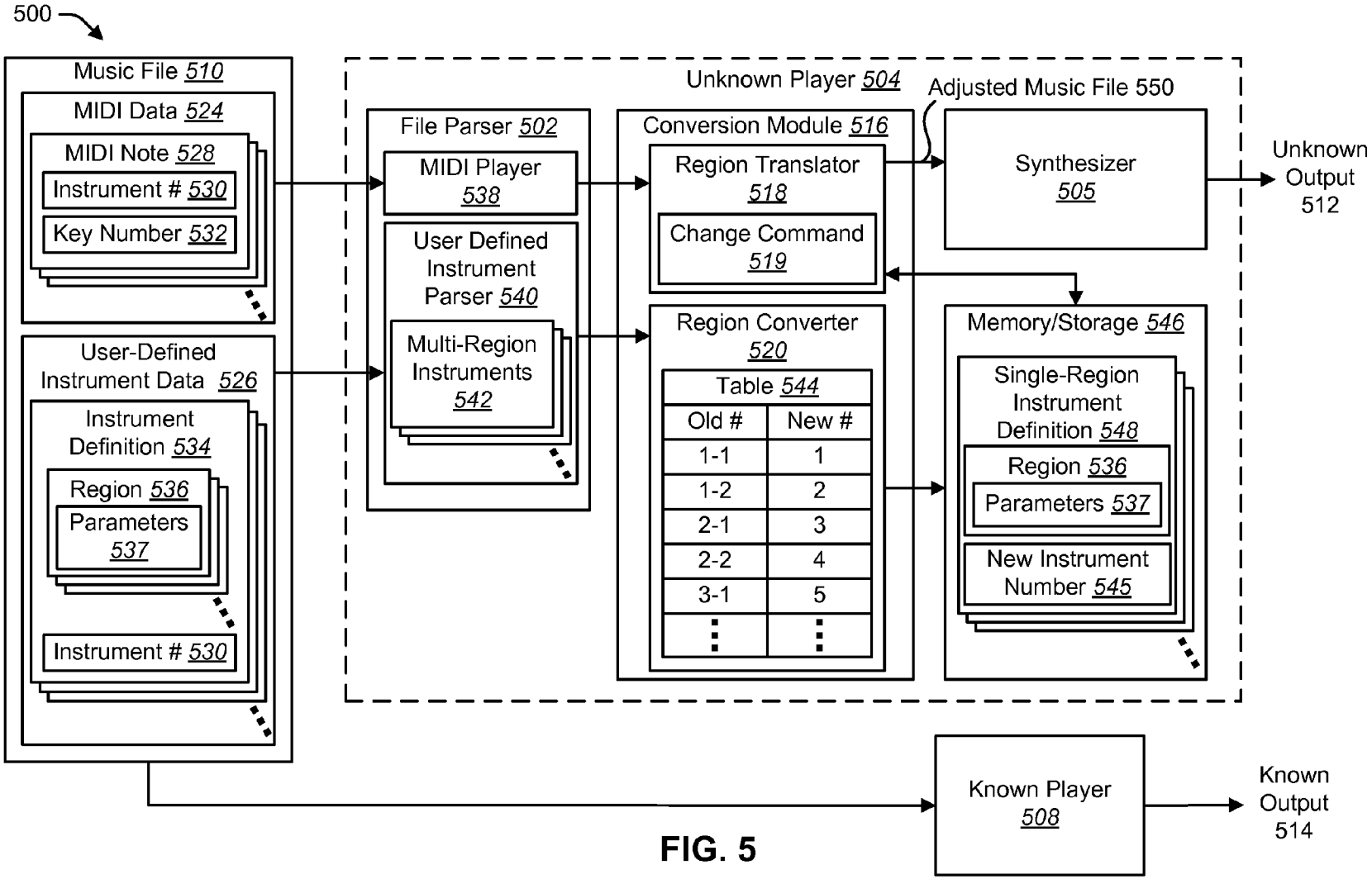
FIG. 5 is a block diagram illustrating a system for providing multi-region instrument support in an audio player.

FIG. 5 is a block diagram illustrating a system 500 for providing multi-region instrument support in an audio player. As before, there may be an unknown player 504 and a known player 508 that receive a music file 510 that includes MIDI data 524 and user-defined instrument data 526. The unknown player 504 may not support multi-region instruments 542. The MIDI data 524 may include one or more MIDI notes 528, each including, among other data, an instrument number 530 and a key number 532. The instrument number 530 may indicate to the synthesizer which instrument definition 534 should be used when playing the MIDI note 528 and the key number 532 may indicate the pitch of the MIDI note 528. As used herein, the term "instrument definition" refers to any electronic file or set of data that is used by an audio player to produce an output. The terms "instrument definition" and "instrument" may be used interchangeably herein.

The music file 510 may also include user-defined instrument data 526 that may be a DLS file including instrument definitions 534 for each instrument in the MIDI data 524. The DLS format allows each instrument definition 534 to have multiple regions 536. Each region 536 may also include other parameters 537 that help the synthesizer 505 to play the music file 510 in a predictable way. These parameters 537 may include a root note, waveform, volume level, volume envelope parameters (attack rate, decay rate, release rate), pitch envelope parameters (attack rate, decay rate, release rate), time-varying filter parameters, etc. The root note may be the note with which the unmodified waveform is associated. In other words, if the root note is selected to be played, a player may output the waveform associated with the region without any pitch modifications. Each instrument definition 534 may also include an instrument number 530 so that the synthesizer 505 may use the correct parameters based on the instrument number 530 in the MIDI data 524.

Some file formats that are either company specific or player specific may not support an instrument definition 534 with more than one region 536. The authoring tool for single region players may throw out an error mentioning that it cannot handle such instrument definitions 534. Alternatively, the authoring tool may use the first region 536 for the entire range of keys within an instrument definition 534. In either case, the unknown output 512 may not sound as expected.

To support DLS files through single region players, any multiple region instruments 534 in the music file 510 may need to be represented as a single region instrument or instruments. This may require mapping the instrument definitions 534 of multi-region instruments into single region instruments and may also require changes to the MIDI data 524 based upon the mapping. Specifically, the instrument numbers 530 in the MIDI data 524 may be changed. This technique is described below.

First, the file parser 502 may receive the music file 510 and divide it into two portions, the MIDI Data 524 and the user defined instrument data 526. The user defined instrument parser 540 may then identify all the instruments 534 with multiple regions in the user defined instrument data 526 and storing a list of multi-region instruments. The MIDI player 538 may further parse the MIDI data 524. Likewise, the user defined instrument parser 540 may parse the user defined instrument data 526 and create instruments 542 with waveform definitions. For example, if the music file 510 is an XMF file, the file parser 502 may be an XMF parser and may convert the music file 510 into player specific data. If the unknown player 504 is a SMAF player, the file parser 502 may convert the MIDI data 524 into the SMAF format. Alternatively, or in addition, the music file 510 may be converted to a player specific format by the conversion module 516. Also, the file parser 502 may inform the conversion module 516 of relevant parameters in the synthesizer 505, such as whether the synthesizer 505 supports multi-region instruments 542 or not.

Second, the region converter 520 in the conversion module 516 may map the multi-region instrument definitions 542 into single region instrument definitions 548. This may include creating new single region instrument definitions 548 that have the same parameters 537 as the region from which they were mapped in the original instrument definitions 534. In other words, the region converter 520 may create as many new single region instrument definitions 548 as there are total regions in the multi-region instrument definitions 534. For example, if there were five instrument definitions 534 in the user-defined instrument data 526, each having two regions 536, the region converter 520 may create ten single-region instrument definitions 548. These new single-region instrument definitions 548 may be stored in memory or any other suitable storage medium 546. The same parameters 537 in the region 536 in the multi-region instrument definitions 534 may be maintained in the single-region instrument definitions 548.

Third, the region converter 520 may assign an instrument number 545 that is not already taken in the user-defined instrument data 526. This may include reusing one or more numbers from the user-defined instrument data 526. The region converter 520 may utilize a table 544 or some other data structure to do this mapping. For example, a table 544 may map multi-region instrument numbers 530 to single region instrument numbers 545 as shown: region 1, instrument 1 maps to new instrument 1; region 2, instrument 1 maps to new instrument 2; region 1, instrument 2 maps to instrument 3; region 2, instrument 2 maps to instrument 4; region 1, instrument 3 maps to instrument 5. Note that one or more multi-region instrument numbers 530 may be reused as single region instrument numbers 545, e.g., region 1 in multi-region instrument 1 may be mapped into single region instrument 1. Since MIDI only supports instrument numbers 0-127, this mapping may use all of the supported instrument numbers 530. If there are no available instrument numbers 530 in the bank, a new bank of instruments may be created and the same procedure may be followed. The mapping and instrument number 530 assignment may occur only once in the system 500.

Fourth, the MIDI data 524 may be adjusted by the region translator 518. This may include searching for MIDI notes 528 that use instruments that have been assigned new instrument numbers 545. If the note 528 is a note ON or a note OFF message, a program change command 519 may be inserted before the note 528 is sent to the synthesizer 505. For example, if the region translator 518 found a note ON message for the second region in instrument 0x10 that had previously been mapped into two single region instruments 0x10 and 0x20, the region translator 518 may send a program change command 519 to 0x20 before sending the note 528. It may not be necessary, however, to send another program change command 519 for consecutive note ON messages 528 to the same region 536. Likewise, it may not be necessary to send another program change command 519 for consecutive note ON messages 528 to the same region 536. Further, if the mapped single region instrument definition 548 used by the note 528 is in a different bank of instruments, a bank change command 519 may be sent before any note ON or note OFF messages 528. For any channel specific messages like channel volume, the same message 528 may be replicated multiple times to reflect the message 528 on all the channels on which the original instrument 534 is being played.

Lastly, the single region instrument definitions 548 and the MIDI data 524 may be combined into an adjusted music file 550. The adjusted music file 550 may be in a synthesizer-specific format that may be used directly by the synthesizer 505 to produce the unknown output 512. Likewise, the music file 510 may be converted before it is played by the known player 508 to produce the known output 514. In one configuration, the conversion module 516, and not the file parser 502 may convert the MIDI data 524 into player specific MIDI data and convert the user defined instrument data 526 into player specific user defined instrument data and combine them into an adjusted music file 550. The player specific MIDI data may include the change commands and the player specific user defined instrument data may include the single region instrument definitions 548.

It should be noted that the system 500 may operate on a note-by-note basis or a file-by-file basis. In a note-by-note basis, the single region instrument definitions 548 may be mapped and saved, then each MIDI note 528 may be sent to the synthesizer 505 with any applicable change commands 519 before all the MIDI notes 528 have been searched. Alternatively, or in addition, all the MIDI notes 528 may be searched and applicable program change commands 519 inserted into the MIDI data 524 before the MIDI notes 528 are sent to the synthesizer 505.

Figure 6:
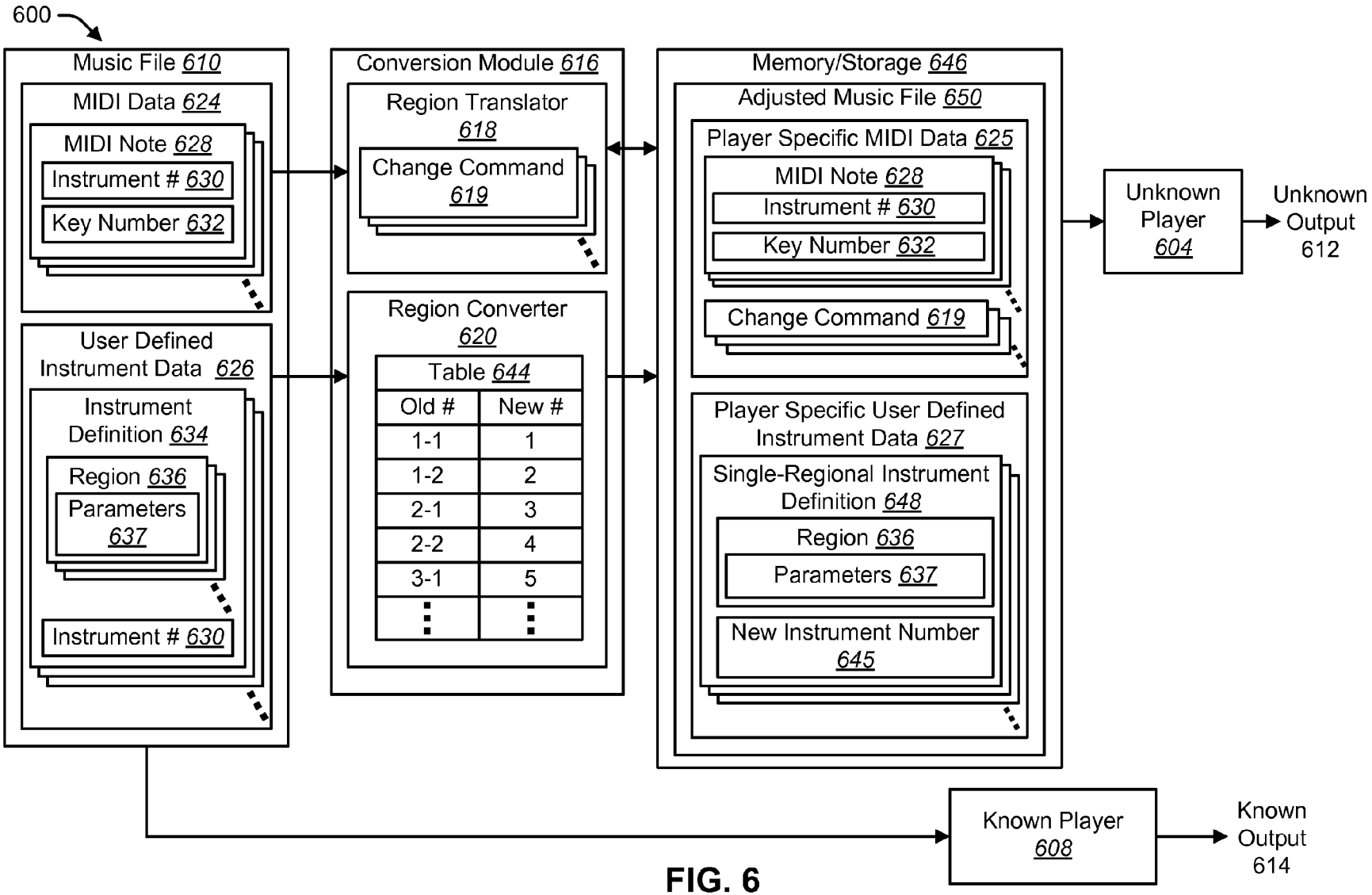
FIG. 6 is a block diagram illustrating another configuration of a system for providing multi-region instrument support in an audio player.

FIG. 6 is a block diagram illustrating another configuration of a system 600 for providing multi-region instrument support in an audio player. As before, a music file 610 including both MIDI data 624 and user defined instrument data 626 is adjusted using a conversion module 616. The MIDI data 624 may include MIDI notes 628, each including, among other things, an instrument number 630 for the note 628 and a key number 632 for the note 628. The user defined instrument data 626 may include instrument definitions 634 that may include one or more regions 636 and instrument numbers 630 associated with the instrument definitions 634. Each region 636 may include other parameters 637 such as a root note and waveform.

The region converter 620 in the conversion module 616 may map the multi-region instruments 634 in the music file 610 into single region instrument definitions 648. The region converter 620 may use a table 644 or other data structure to assign a new instrument number 645 to each single region instrument 648. Additionally, the region 636 in each single region instrument may include the same parameters 637 as are included in the music file 610.

The region translator 618 may include change commands 619, such as program change commands and bank change commands, which may be inserted before notes 628 using newly mapped instruments 648. For example, if the region translator 618 found a note ON message for the second region in instrument 0x10 that had previously been mapped into two single region instruments 0x10 and 0x20, the region translator 618 may send a program change command 619 to 0x20 before sending the note 628.

The conversion module 616 may convert the MIDI data 624 into player specific MIDI data 625 and convert the user defined instrument data 626 into player specific user defined instrument data 627 and combine them into an adjusted music file 650. The player specific MIDI data 625 may include the change commands 619 inserted where appropriate and the player specific user defined instrument data 627 may include the single region instrument definitions 648 with the new instrument numbers 645. The adjusted music file 650 may also be stored in memory 646 or another suitable storage medium.

The adjusted music file 650 may then be sent to the unknown player 604 that may not otherwise support multi-region instruments 634. However, with the conversion module 616, the unknown output 612 may be similar to the known output 614 from the known player 608. It should be noted that a file by file basis is illustrated here, where the entire adjusted music file 650 is combined and saved before the unknown player 604 plays the adjusted file 650. However, the system 600 may also operate on a note by note basis. In other words, rather than inserting all applicable change commands 619 in the MIDI data 624 before sending the adjusted music file 650 to the unknown player 604, the conversion module 616 may send the notes 628 to the unknown player 604 as it receives the notes 628 and inserts the applicable change commands 619 for the notes 628.

Figure 7:
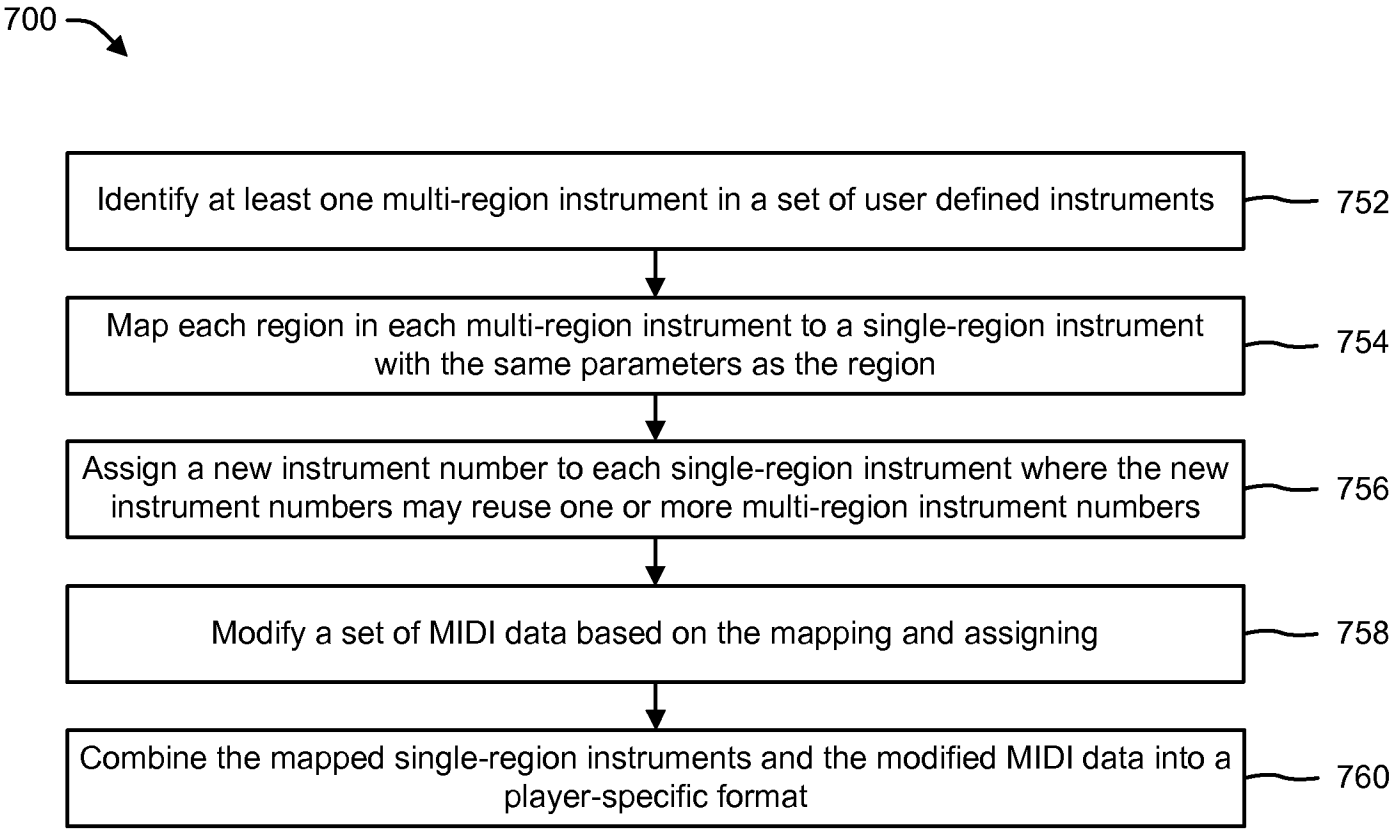
FIG. 7 is a flow diagram illustrating a method for providing multi-region instrument support in an audio player.

FIG. 7 is a flow diagram illustrating a method 700 for providing multi-region instrument support in an audio player. For example, the method may be implemented to allow an unknown player 604 to play a music file 610 with multi-region instruments 634, where the unknown player 604 may not otherwise support multi-region instruments 634. The method 700 may be performed by a conversion module 616. The conversion module 616 may identify 752 at least one multi-region instrument 634 in a set of user defined instruments 634. The module 616 may then map 754 each region 636 in each multi-region instrument 634 to a single region instrument 648 with the same parameters 637 as the region 636.

The module 616 may then assign 756 a new instrument number 645 to each single region instrument 648. The new instrument number 645 may reuse one or more instrument numbers 630 of the multi-region instrument 634, e.g., region 1 in multi-region instrument 1 may be mapped into single region instrument 1. If there are no available instrument numbers 630 in the bank, a new bank of instruments may be created and the same procedure may be followed.

Next, the MIDI data 624 may be modified 758 based on the mapping 754 and assigning 756. In other words, the MIDI data 624 may be modified to allow a player 604 or synthesizer 605 to associate the correct single region instrument definitions 648 with the received notes 628. This modification 758 may include inserting a change command 619 before one or more notes 628. For example, if the conversion module 616 found a note ON message for the second region 636 in instrument 0x10 that had previously been mapped into two single region instruments 0x10 and 0x20, the conversion module 616 may send a program change command 619 to 0x20 before sending the note 628. Lastly, the mapped single region instruments 648 and the modified MIDI data 624 may be combined 760 into an adjusted music file 650 that is player specific. This may include converting the MIDI data 624 into player specific MIDI data 625 and converting the user defined instrument data 626 into player specific user defined instrument data 627 before combining them into the adjusted music file 650.

Figure 7A:
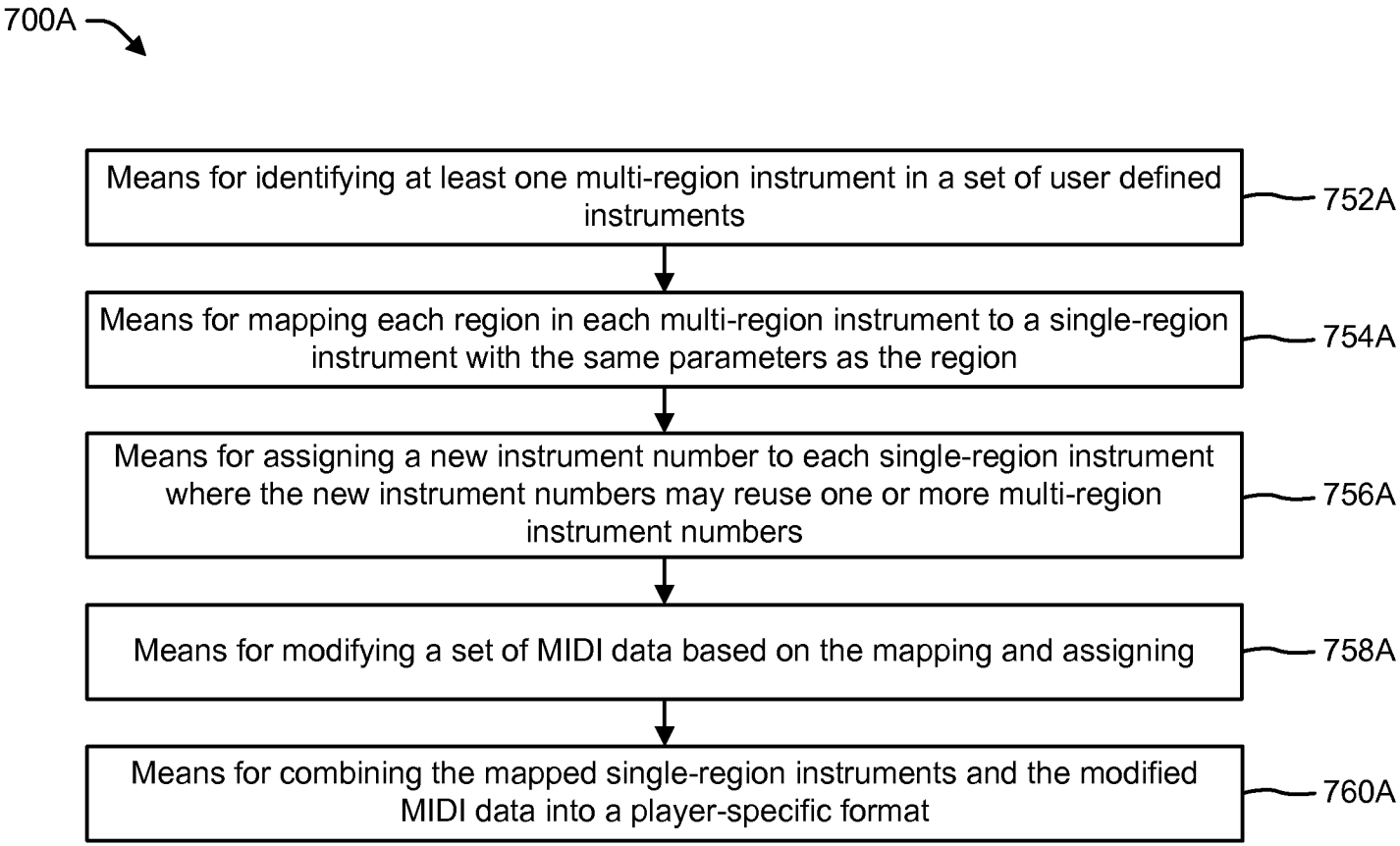
FIG. 7A illustrates means-plus-function blocks corresponding to the method of FIG. 7.

The method 700 of FIG. 7 described above may be performed by various hardware and/or software component(s) and/or module(s) corresponding to the means-plus-function blocks 700A illustrated in FIG. 7A. In other words, blocks 752 through 760 illustrated in FIG. 7 correspond to means-plus-function blocks 752A through 760A illustrated in FIG. 7A.

Figure 8:
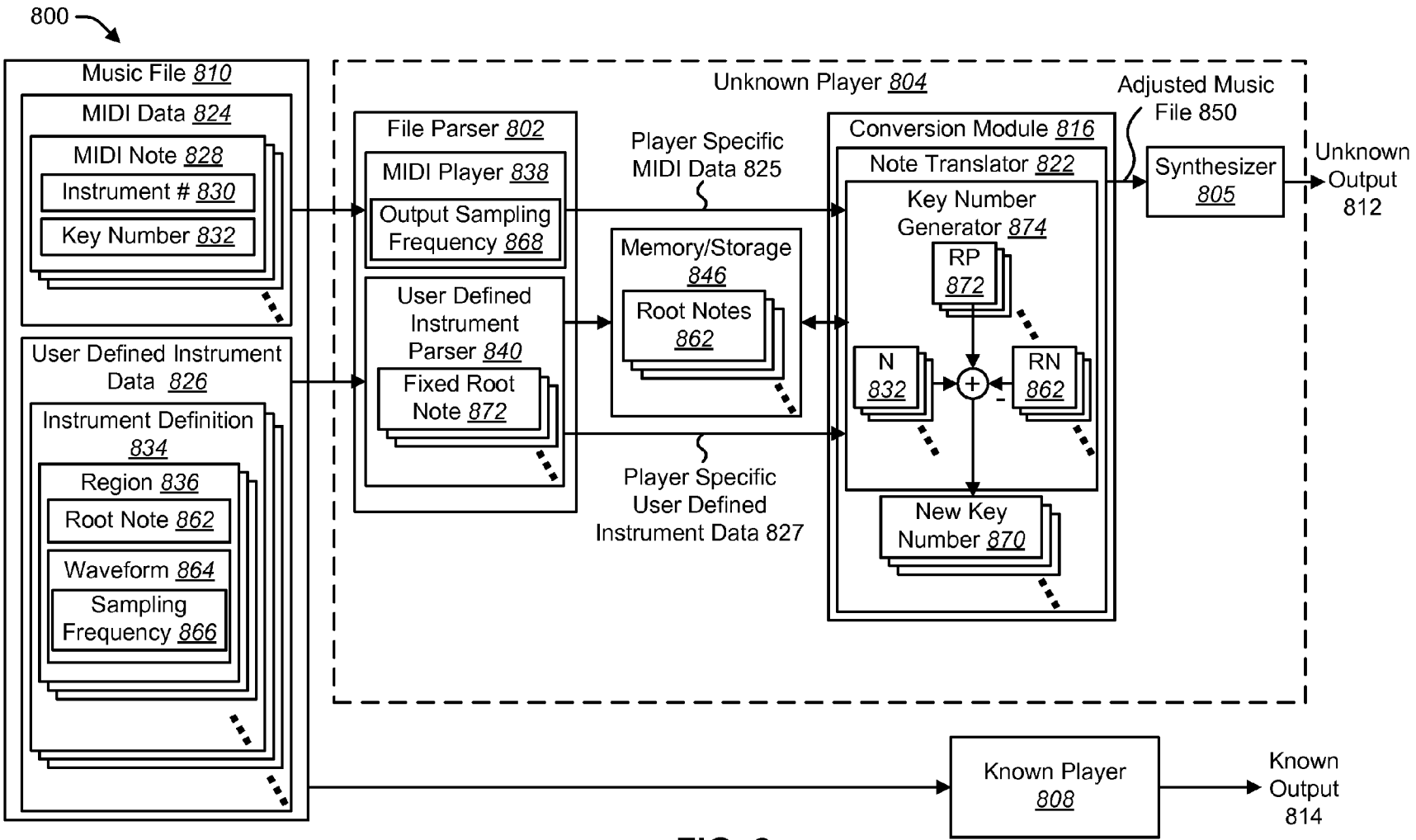
FIG. 8 is a block diagram illustrating a system for providing variable root note support in an audio player.

FIG. 8 is a block diagram illustrating a system 800 for providing variable root note support in an audio player. This may include a conversion module 816 that adjusts MIDI data 824 inside an unknown player 804 that would otherwise not support variable root notes 862. Some file formats, such as DLS, may allow a user to define any note 828 in an instrument region 836 as the root note 862 for that region 836. The root note 862 may be the note with which the unmodified waveform 864 is associated. In other words, if the root note 862 is selected to be played, the unknown player 804 may output the waveform 864 associated with the region 836 without any pitch modifications. If a non-root note is selected to be played, however, the pitch of the waveform 864 may be changed to achieve the desired output. There may also be modulation or other non-pitch modifications to the waveform 864, even for root notes 862. For example the waveform 864 may be resampled to account for different sampling frequencies, as described below.

The music file 810 may include MIDI data 824 that includes MIDI notes 828, each with an instrument number 830 and a key number 832. The instrument number 830 may associate the synthesizer 805 with a set of parameters used to represent the instrument. The key number 832 may be a number indicating the pitch of the note 828, e.g., middle C may be represented by the key number 832 of "60" and may be denoted by "N" herein.

The music file 810 may also include user defined instrument data 826 that may include instrument definitions 834, each with one or more regions 836. The user defined root note (RN) 862 may be the note with which the unmodified waveform 864 is associated. Each waveform 864 may have a sampling frequency (Fw) 866 at which the waveform 864 was sampled.

If the output sampling frequency (Fs) 868 of the MIDI player 838 is different than the waveform 864 sampling frequency (Fw) 866 of the note 828 to be played, the MIDI player 838 may resample the waveform 864. The resampling ratio may be Fw/Fs. When playing a non-root note in a particular region 836, the MIDI player 838 may resample the waveform 864. So, the resampling ratio for a MIDI player 838 that supports user defined root notes 862 may be given by:

$$2^{((N-RN)/12)}*Fw/Fs \quad (1)$$

In general, the MIDI notes 828 being played may be concentrated around the root note 862 so that MIDI player 838 may minimize the distortion as a result of resampling. Resampling may take place in the synthesizer 805.

However, some audio players 804 that support user defined instruments 834 using wavetable synthesis may not support user defined root notes 862. Instead, the player 804 may use a fixed root note (RP) 872. The fixed root note (RP) 872 may not be described in the instrument definitions 834 and may not be saved anywhere, but rather may be internal to the player 804, e.g., RP 872 may be the property of the synthesizer 805. For the unknown player 804 to play a MIDI note 828 other than the fixed root note 872, the waveform 864 may be resampled according to the following equation:

$$2^{((N-RP)/12)}*Fw/Fs \quad (2)$$

To support the user defined instruments 834 in the unknown player 804, the instruments 834 may be mapped to a player specific format. Since the unknown player 804 may use a fixed root note 872 rather than user defined root notes 862, the key number (N) 832 may be adjusted such that the effective resampling ratio remains the same.

The file parser 802 may correspond to the music file 810. For example, if the music file 810 is an XMF file, the file parser 802 may be an XMF parser. The file parser 802 may convert the music file 810 into player specific data. Specifically, the MIDI player 838 may convert the MIDI data 824 into player specific MIDI data 825. Likewise, the user defined instrument parser 840 may also convert the user defined instrument data 826 into player specific user defined instrument data 827 that may later be combined with the player specific MIDI data 825.

Also, the file parser 802 may inform the conversion module 816 of relevant parameters in the synthesizer 805. For example, the parser 802 may include information about the fixed root note 872 for each MIDI instrument 834. Likewise, the MIDI player 838 may include information about the output sampling frequency (Fs) 868.

The user defined instrument parser 840 may extract and store an array of user defined root notes 862 from the instrument definitions 834 in memory or another suitable storage medium 846. The array of root notes 862 may be used by the conversion module 816 to adjust the key numbers (N) 832 in the MIDI data 824. Alternatively, the root notes 862 may be stored as any type of data structure.

The key number generator 874 in the note translator 822 may then generate new key numbers (N') 870 for each MIDI note 828 such that the correct pitch will be played even after resampling. By way of example, assume that note (N) 828 is to be played on an instrument region with user defined root note (RN) 862. Further, assume that the player specific file format assumes a fixed root note (RP) 872. Without a conversion module 816, the MIDI player 838 may seek to employ a resampling ratio of 2^(N−RN)/12*Fw/Fs. However, since the unknown player 804 only supports a fixed root note 872, the MIDI player 838 may instead employ a resampling ratio of 2^(N−RP)/12*Fw/Fs. This may lead to pitch differences and hence the unknown output 812 may sound different than the known output 814.

To mitigate this, while writing player specific file format, the note translator 822 may offset key numbers (N) 832 in the MIDI notes 828 such that the resampling ratio used is the same as before. The note translator 822 may replace the key numbers (N) 832 in the music file 810 with a new key number (N') 870 where N'=N+RP−RN. Using this new key number (N') 870, the resampling ratio employed by note translator 822 may be:

$$2^{((N'-RP)/12)}*Fw/Fs \quad (3)$$

which may be equivalent to:

$$2^{((N+RP-RN-RP)/12)}*Fw/Fs \quad (4)$$

which may be equivalent to:

$$2^{((N-RN)/12)}*Fw/Fs \quad (5)$$

which is the required resampling ratio. Thus, by substituting the new key numbers (N') 870 calculated in the note translator 822 for the key numbers (N) 832 in the MIDI notes 828, the resampling ratio may be automatically adjusted as shown in equation (5).

The player specific MIDI data 825 and the player specific user defined instrument data 827 may then be combined into an adjusted music file 850. The adjusted music file 850 may then be sent to the unknown player 804 that may not otherwise support user defined root notes 862. However, with the conversion module 816, the unknown output 812 may be similar to the known output 814 from the known player 808.

It should be noted that the system 800 may operate on a note by note basis or a file by file basis. In a note by note basis, the new key numbers (N') 870 may be determined as the note translator 822 receives each note 828, then each MIDI note 828 may be sent to the synthesizer 805 with the new key numbers (N') 870 before all the MIDI notes 828 have been adjusted. Alternatively, or in addition, all the MIDI notes 828 may be adjusted with new key numbers (N') 870 before any MIDI notes 828 are sent to the synthesizer 805.

Figure 9:
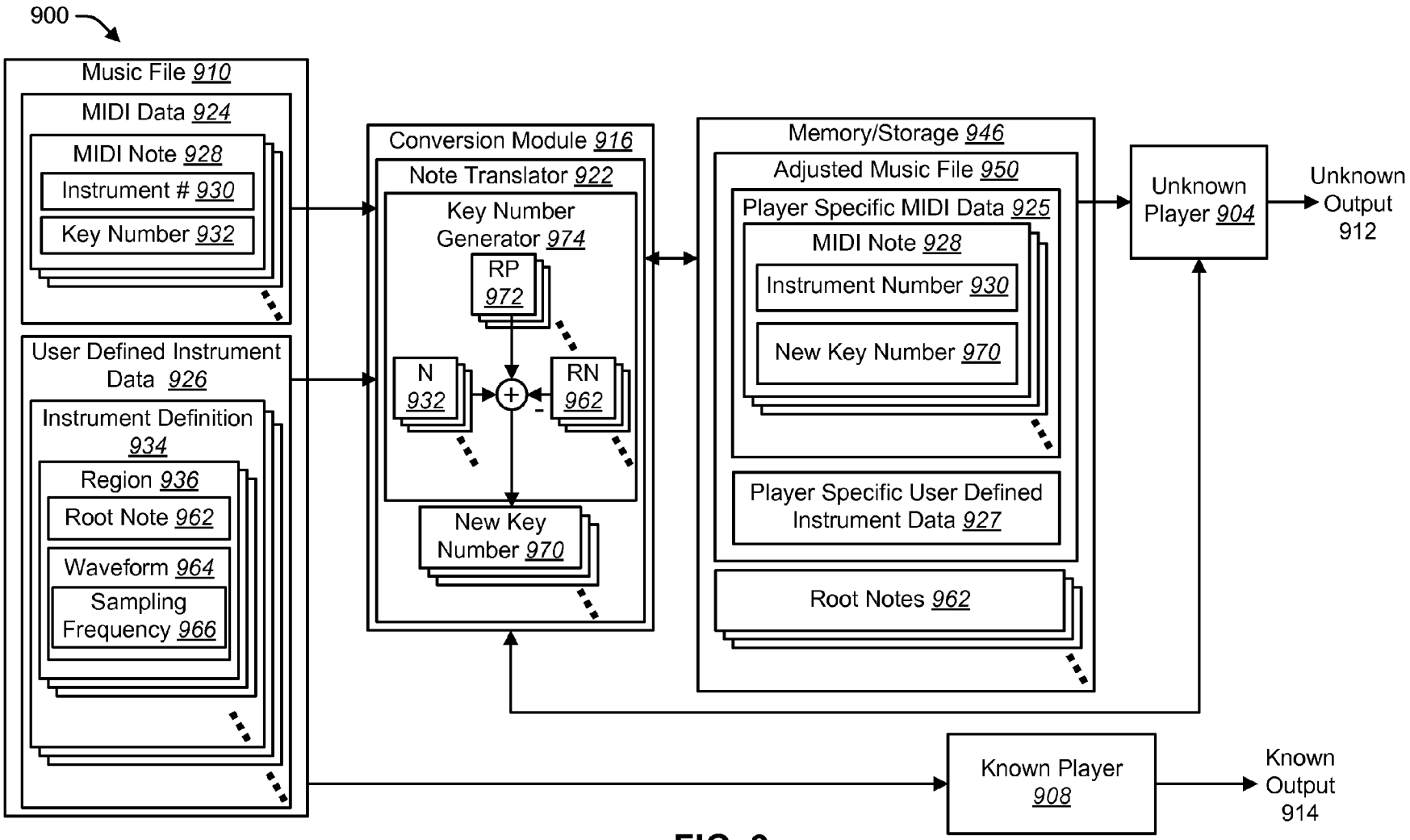
FIG. 9 is a block diagram illustrating another configuration of a system for providing variable root note support in an audio player.

FIG. 9 is a block diagram illustrating another configuration of a system 900 for providing variable root note support in an audio player. As before, a music file 910 including both MIDI data 924 and user defined instrument data 926 may be adjusted using a conversion module 916. The MIDI data 924 may include MIDI notes 928, each including, among other things, an instrument number 930 for the note 928 and a key number (N) 932 for the note 928. The user defined instrument data 926 may include instrument definitions 934 that may include one or more regions 936. Each region 936 may include other parameters such as a root note (RN) 962 and waveform 964 with a sampling frequency (Fw) 966.

The note translator 922 in the conversion module 916 may generate new key numbers (N') 970 using the key number generator 974 that sums N 932, RP 972, and −RN 962, where RP 972 is the fixed root note 972 for the instrument 934 used by each note 928. An array of the user defined root notes (RN) 962 may be stored in memory or other suitable storage medium 946. Additionally, the conversion module 916 may communicate with the unknown player 904 to determine the fixed root notes (RP) 972.

The conversion module 916 may convert the MIDI data 924 into player specific MIDI data 925 and convert the user defined instrument data 926 into player specific user defined instrument data 927 and combine them into an adjusted music file 950. The player specific MIDI data 925 may include the new key numbers (N') 970 in the place of the key numbers (N) 932. The adjusted music file 950 may also be stored in memory or another suitable storage medium 946.

The adjusted music file 950 may then be sent to the unknown player 904 that may not otherwise support user defined root notes 962. However, with the conversion module 916, the unknown output 912 may be similar to the known output 914 from the known player 908. It should be noted that a file by file basis is illustrated here, where an entire adjusted music file 950 is combined and saved before the unknown player 904 plays the adjusted file 950. However, the system 900 may also operate on a note by note basis. In other words, rather than replacing all the key numbers (N) 932 in the MIDI data 924 with new key numbers (N') 970 before sending the adjusted music file 950 to the unknown player 904, the conversion module 916 may send the notes 924 to the unknown player 904 as it receives the notes 924 and replaces the key numbers (N) 932 with new key numbers (N') 970.

Figure 10:
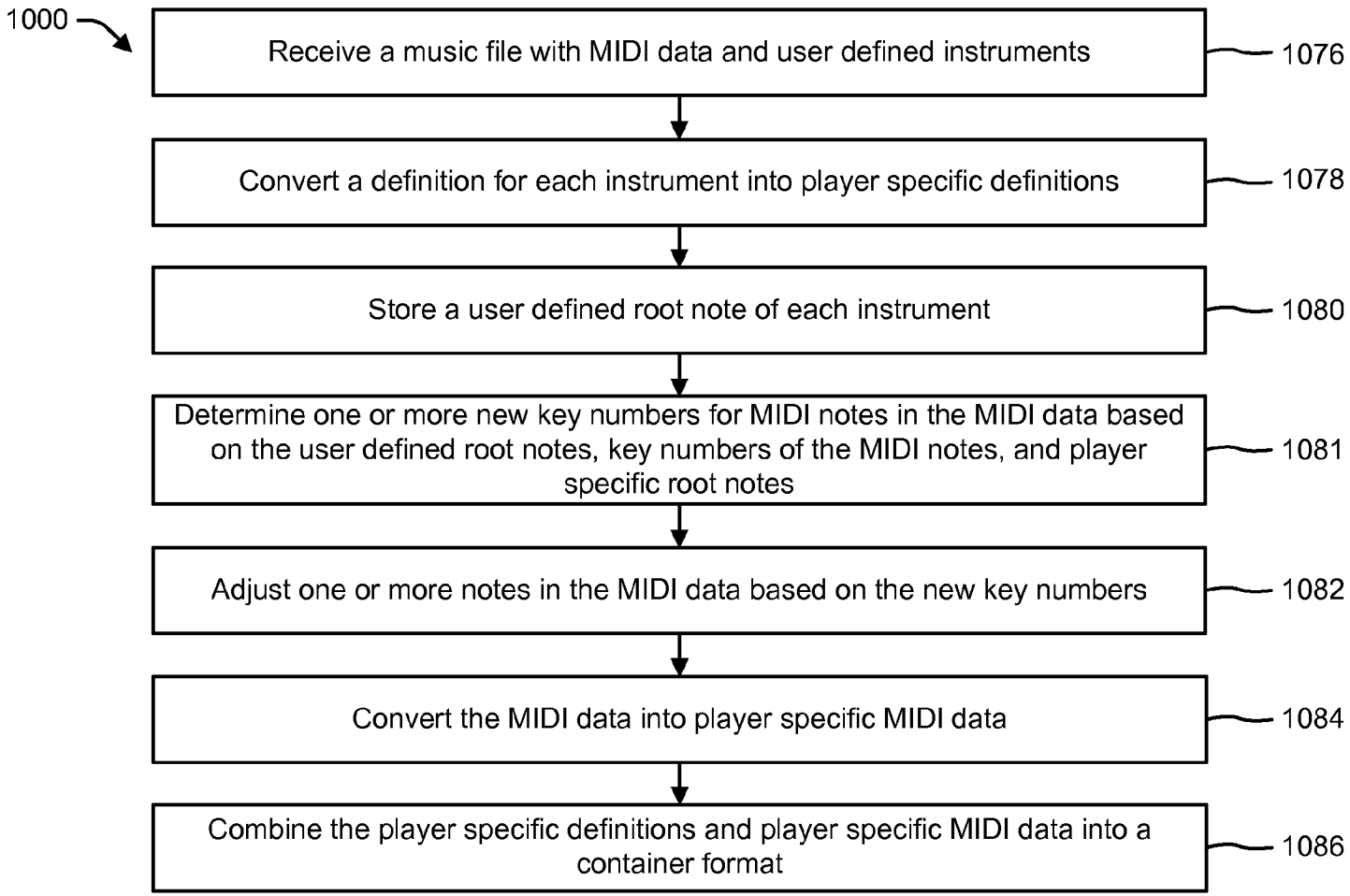
FIG. 10 is a flow diagram illustrating a method for providing variable root note support in an audio player.

FIG. 10 is a flow diagram illustrating a method 1000 for providing variable root note support in an audio player. For example, the method 1000 may be implemented to allow an unknown player 904 to play a music file 910 with user defined root notes 962, where the unknown player 904 may not otherwise support user defined root notes 962. The method 1000 may be performed by a conversion module 916. The conversion module 916 may receive 1076 a music file 910 with MIDI data 924 and user defined instruments 934. The instrument definitions 934 may then be converted 1078 into player specific definitions 927. The conversion module 916 may store 1080 the user defined root notes 962 of each instrument 934 in a data structure, such as an array. A new key number (N') 970 may be determined 1081 using N 932, RP 972, and RN 962 for each note, e.g., N'=N+RP−RN. The conversion module 916 may then adjust 1082 one or more notes 928 in the MIDI data 924 based on the new key numbers (N') 970. In other words, the key numbers (N) 932 may be replaced by the new key numbers (N') 970. The MIDI data 924 may then be converted 1084 into player specific MIDI data 925. Lastly, the player specific MIDI data 925 and the player specific instrument definitions 927 may be combined 1086 into an adjusted music file 950.

Figure 10A:
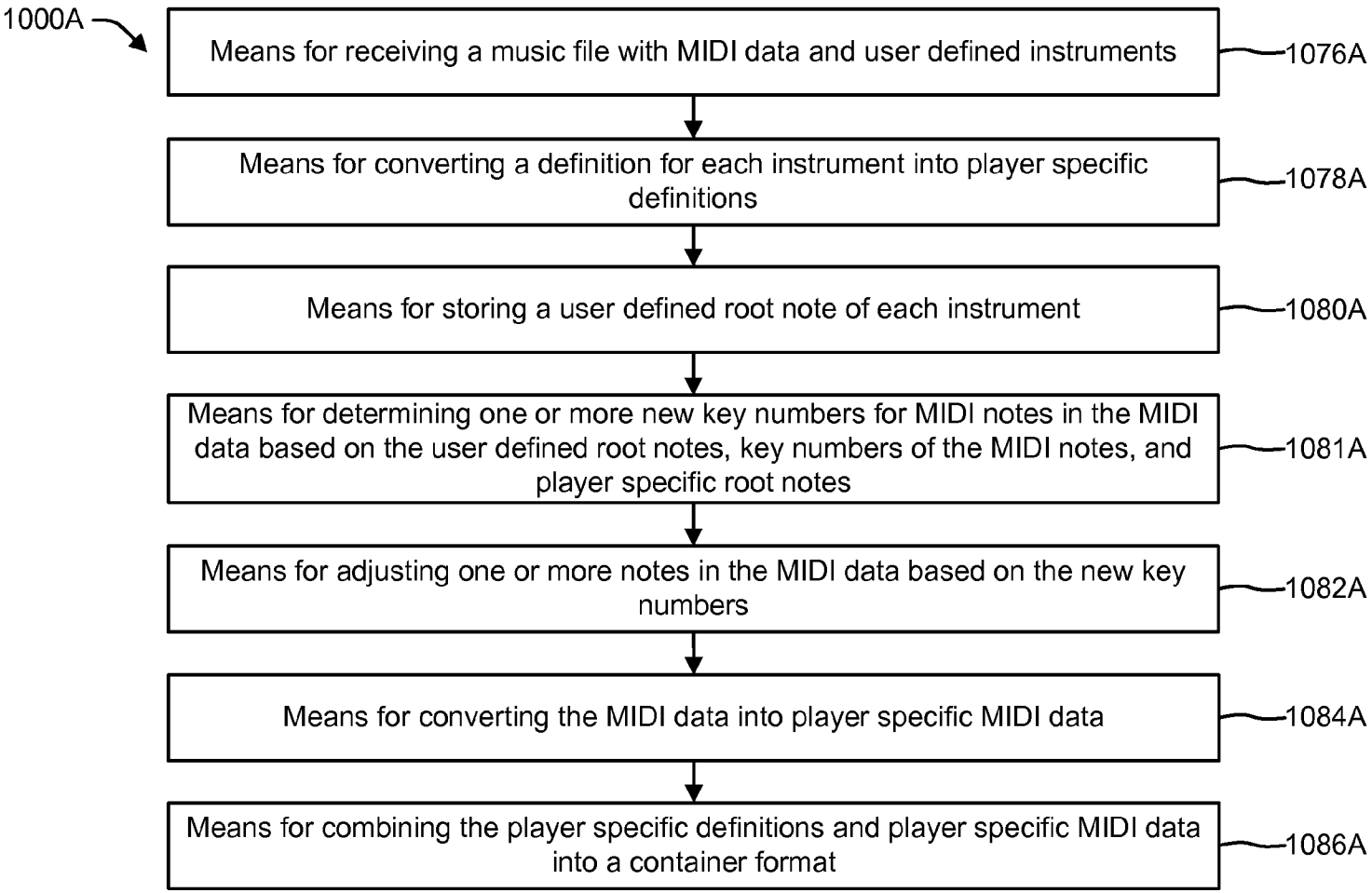
FIG. 10A illustrates means-plus-function blocks corresponding to the method of FIG. 10.

The method 1000 of FIG. 10 described above may be performed by various hardware and/or software component (s) and/or module(s) corresponding to the means-plus-function blocks 1000A illustrated in FIG. 10A. In other words, blocks 1076 through 1086 illustrated in FIG. 10 correspond to means-plus-function blocks 1076A through 1086A illustrated in FIG. 10A.

Figure 11:
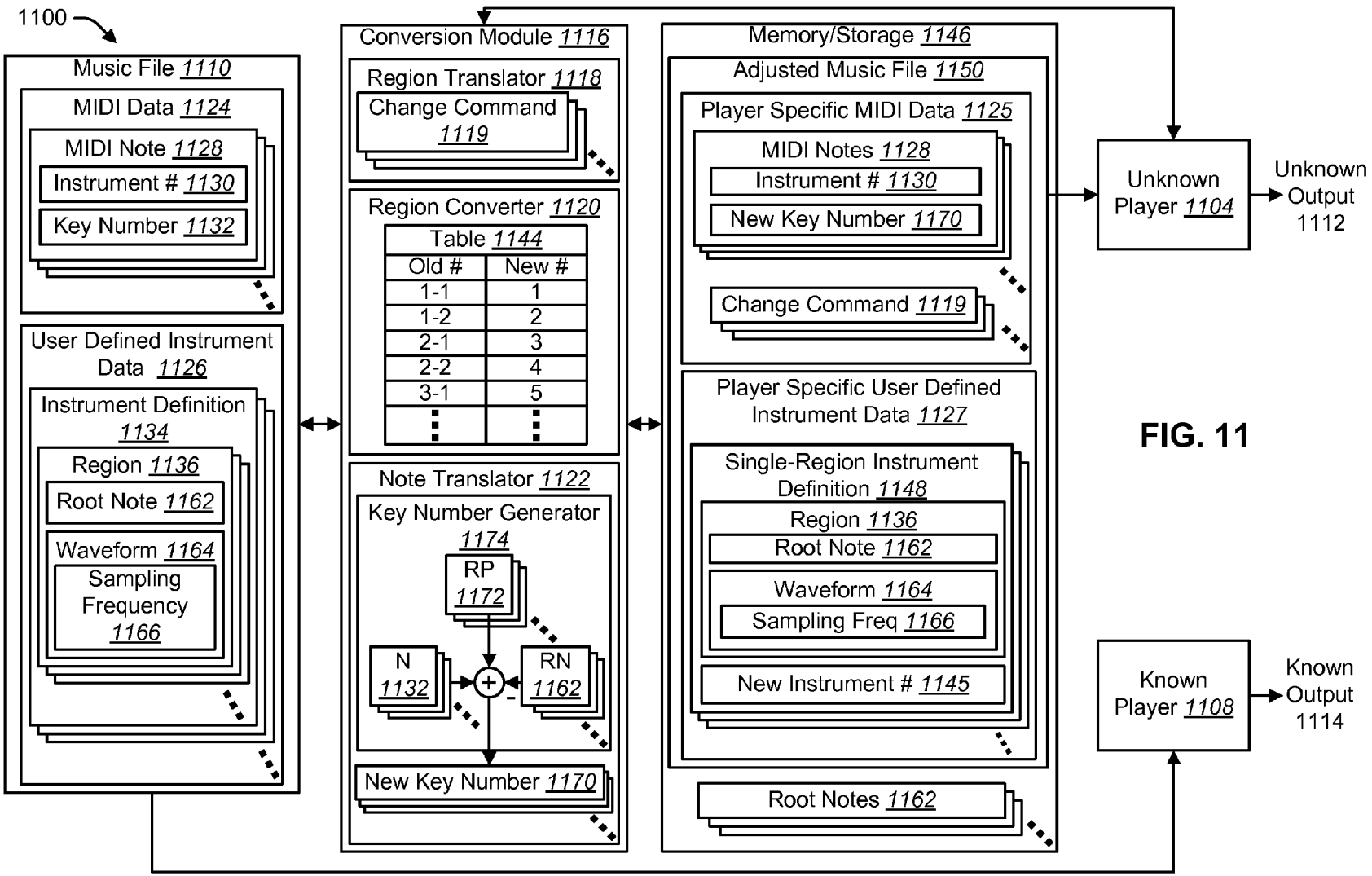
FIG. 11 is a block diagram illustrating a system for providing multi-region instrument support and variable root note support to an audio player.

FIG. 11 is a block diagram illustrating a system 1100 for providing multi-region instrument support and variable root note support to an audio player. As before, a music file 1110 including both MIDI data 1124 and user defined instrument data 1126 may be adjusted using a conversion module 1116. The MIDI data 1124 may include MIDI notes 1128, each including, among other things, an instrument number 1130 for the note 1128 and a key number (N) 1132 for the note 1128. The user defined instrument data 1126 may include instrument definitions 1134 that may include one or more regions 1136 and instrument numbers 1130 associated with the instrument definitions 1134. Each region 1136 may include other parameters such as a root note (RN) 1162 and a waveform 1164 with a sampling frequency (Fw) 1166.

First, the conversion module 1116 may map the multi-region instruments 1134 in the music file 1110 into single region instrument definitions 1148. The region converter 1120 may use a table 1144 or other data structure to assign a new instrument number 1145 to each single region instrument 1148. Additionally, the region 1136 in each single region instrument 1148 may include the same root note 1162 and waveform 1164 that are included in the music file 1110.

The region translator 1118 may include change commands 1119, such as program change commands and bank change commands that may be inserted before any notes 1128 using newly mapped instruments 1148. The MIDI data 1124, with inserted change commands 1119, may be combined with the single region instruments 1148 into an adjusted music file 1150 and stored in memory or another suitable storage medium 1146.

Next, the note translator 1122 may generate new key numbers (N') 1170 using the key number generator 1174 that sums N 1132, RP 1172, and −RN 1162, where RP 1172 is the fixed root note 1172 for the instrument used by each note 1128. In other words, N'=N+RP−RN. An array of the user defined root notes (RN) 1162 that represent all the regions may be stored in memory or other suitable storage medium 1146. Additionally, the conversion module 1116 may communicate with the unknown player 1104 to determine the fixed root notes (RP) 1172.

The conversion module 1116 may convert the MIDI data 1124 into player specific MIDI data 1125 and convert the user defined instrument data 1126 into player specific user defined instrument data 1127 and combine them into an adjusted music file 1150. The player specific MIDI data 1125 may include the new key numbers (N') 1170 in the place of the key numbers (N) 1132 as well as change commands 1119. The player specific user defined instrument data 1127 may include the single region instrument definitions 1148 with the new instrument numbers 1145. The adjusted music file 1150 may also be stored in memory or another suitable storage medium 1146.

The adjusted music file 1150 may then be sent to the unknown player 1104 that may not otherwise support multi-region instruments 1134 or user defined root notes 1162. However, with the conversion module 1116, the unknown output 1112 may be similar to the known output 1114 from the known player 1108. It should be noted that a file by file basis is illustrated here, where an entire adjusted music file 1150 is combined and saved in memory 1146 before the unknown player 1104 plays the adjusted file 1150. However, the system 1100 may also operate on a note by note basis. In other words, rather than adjusting the MIDI data 1124 and the user defined instrument data 1126 before sending the adjusted music file 1150 to the unknown player 1104, the conversion module 1116 may send the notes 1128 to the unknown player 1104 as it receives the notes 1128 and adjusts them.

Figure 12:
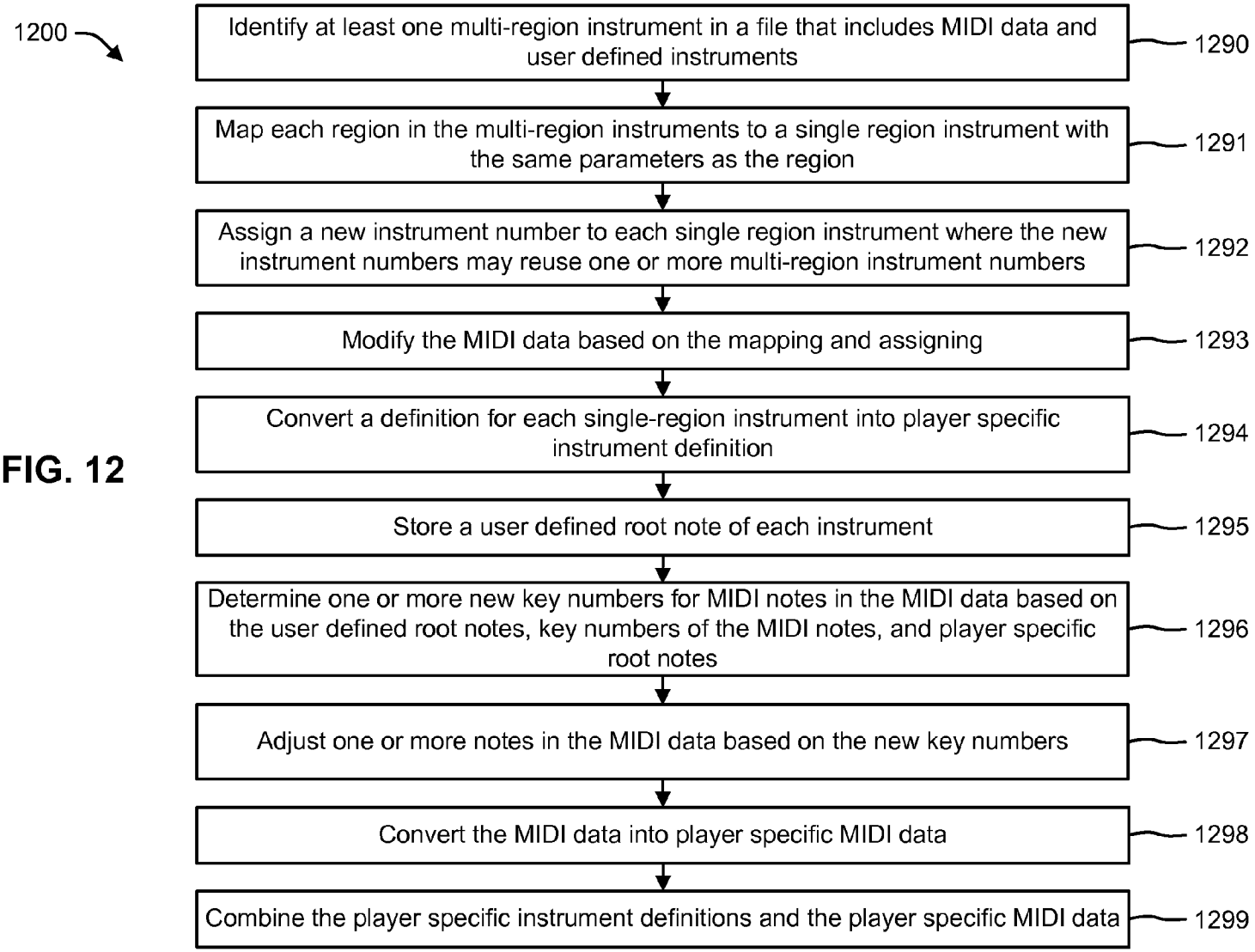
FIG. 12 is a flow diagram illustrating a method for providing multi-region instrument support and variable root note support to an audio player.

FIG. 12 is a flow diagram illustrating a method 1200 for providing multi-region instrument support and variable root note support to an audio player. For example, the method 1200 may be implemented to allow an unknown player 1104 to play a music file 1110 with multi-region instruments 1134 and user defined root notes 1162, where the unknown player 1104 may not otherwise support multi-region instruments 1134 or user defined root notes 1162. The method 1200 may be performed by a conversion module 1116. The first portion of the method 1200 may be directed at providing multi-region support. Accordingly, the conversion module 1116 may identify 1290 at least one multi-region instrument 1134 in a music file 1110 that includes MIDI data 1124 and user defined instrument data 1126. The module 1116 may then map 1291 each region 1136 in the multi-region instruments 1134 to a single region instrument 1148 with the same parameters as the region 1136. These parameters may include a root note 1162 and a waveform 1164 with a sampling frequency 1166.

The module may then assign 1292 a new instrument number 1145 to each single region instrument 1148. The new instrument number 1145 may or may not reuse the instrument number 1130 of the multi-region instrument 1134, e.g., region 1 in multi-region instrument 1 may be mapped into single region instrument 1. If there are no available instrument numbers 1130 in the bank, a new bank of instruments may be created and the same procedure may be followed.

Next, the MIDI data 1124 may be modified 1293 based on the mapping 1291 and assigning 1292. In other words, the MIDI data 1124 may be modified 1293 to allow a player 1104 or synthesizer to associate the correct single region instrument definitions 1148 with the received notes 1128. This modification 1293 may include inserting a change command 1119 before one or more notes 1128. For example, if the conversion module 1116 found a note ON message for the second region 1136 in instrument 0x10 that had previously been mapped into two single region instruments 0x10 and 0x20, the conversion module 1116 may send a program change command 1119 to 0x20 before sending the note 1128.

The music file 1110 may then be modified to support user defined root notes 1162 in the remaining steps of the method 1200. First, the instrument definitions 1134 may then be converted 1294 into player specific definitions 1127. The conversion module 1116 may store 1295 the user defined root notes 1162 of each instrument 1134 in a data structure, such as an array. The conversion module 1116 may store 1295 the user defined root notes 1162 of each instrument 1134 in a data structure, such as an array. A new key number (N') 1170 may be determined 1296 using N 1132, RP 1172, and RN 1162 for each note 1128, e.g., N'=N+RP−RN. The conversion module 1116 may then adjust 1297 one or more notes 1128 in the MIDI data 1124 based on the new key numbers (N') 1170. In other words, the key numbers (N) 1132 may be replaced by the new key numbers (N') 1170. The MIDI data 1124 may then be converted 1298 into player specific MIDI data 1125. Lastly, the player specific MIDI data 1125 and the player specific instrument definitions 1127 may be combined 1299 into an adjusted music file 1150.

Figure 12A:
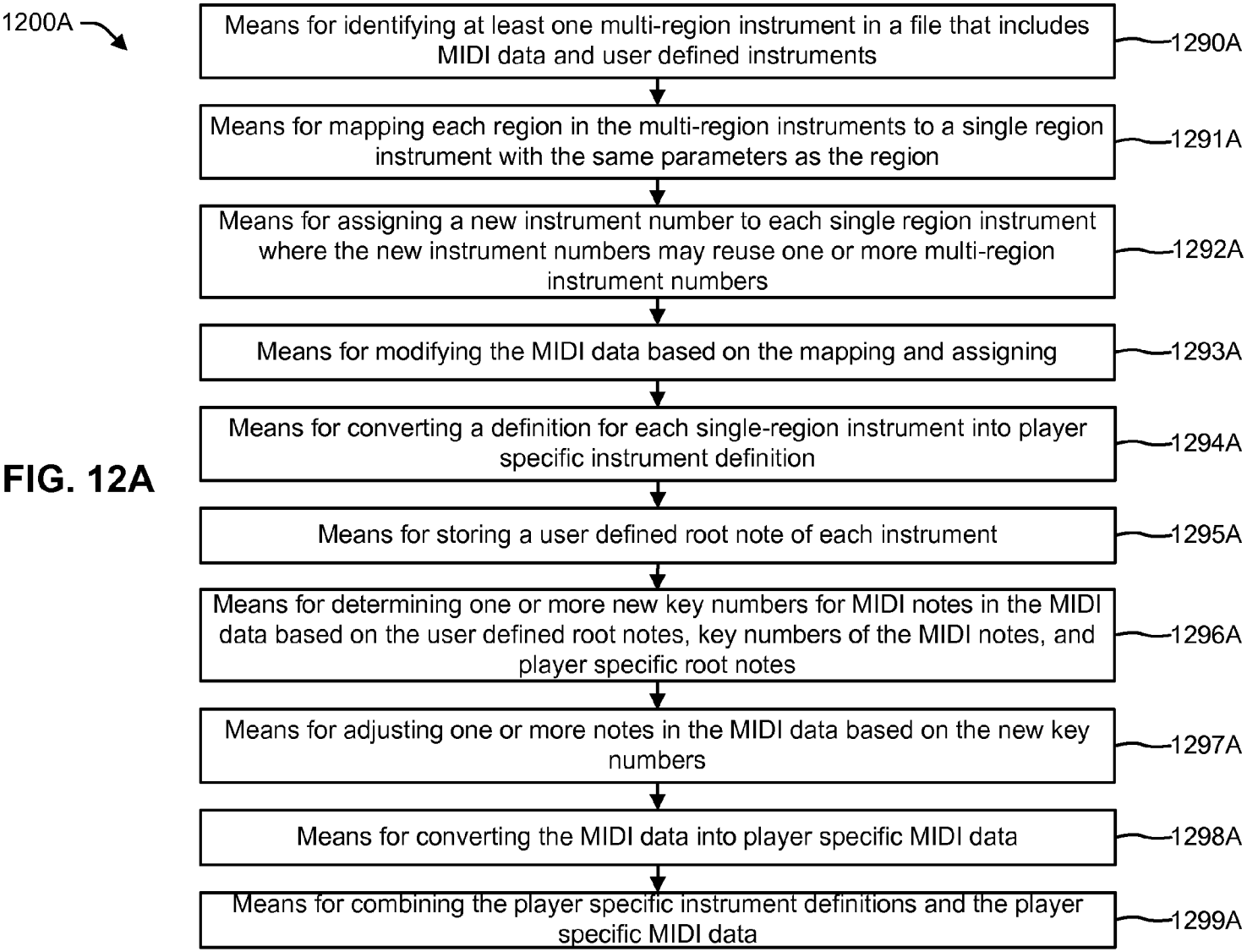
FIG. 12A illustrates means-plus-function blocks corresponding to the method of FIG. 12.

The method 1200 of FIG. 12 described above may be performed by various hardware and/or software component (s) and/or module(s) corresponding to the means-plus-function blocks 1200A illustrated in FIG. 12A. In other words, blocks 1290 through 1299 illustrated in FIG. 12 correspond to means-plus-function blocks 1290A through 1299A illustrated in FIG. 12A.

Figure 13:
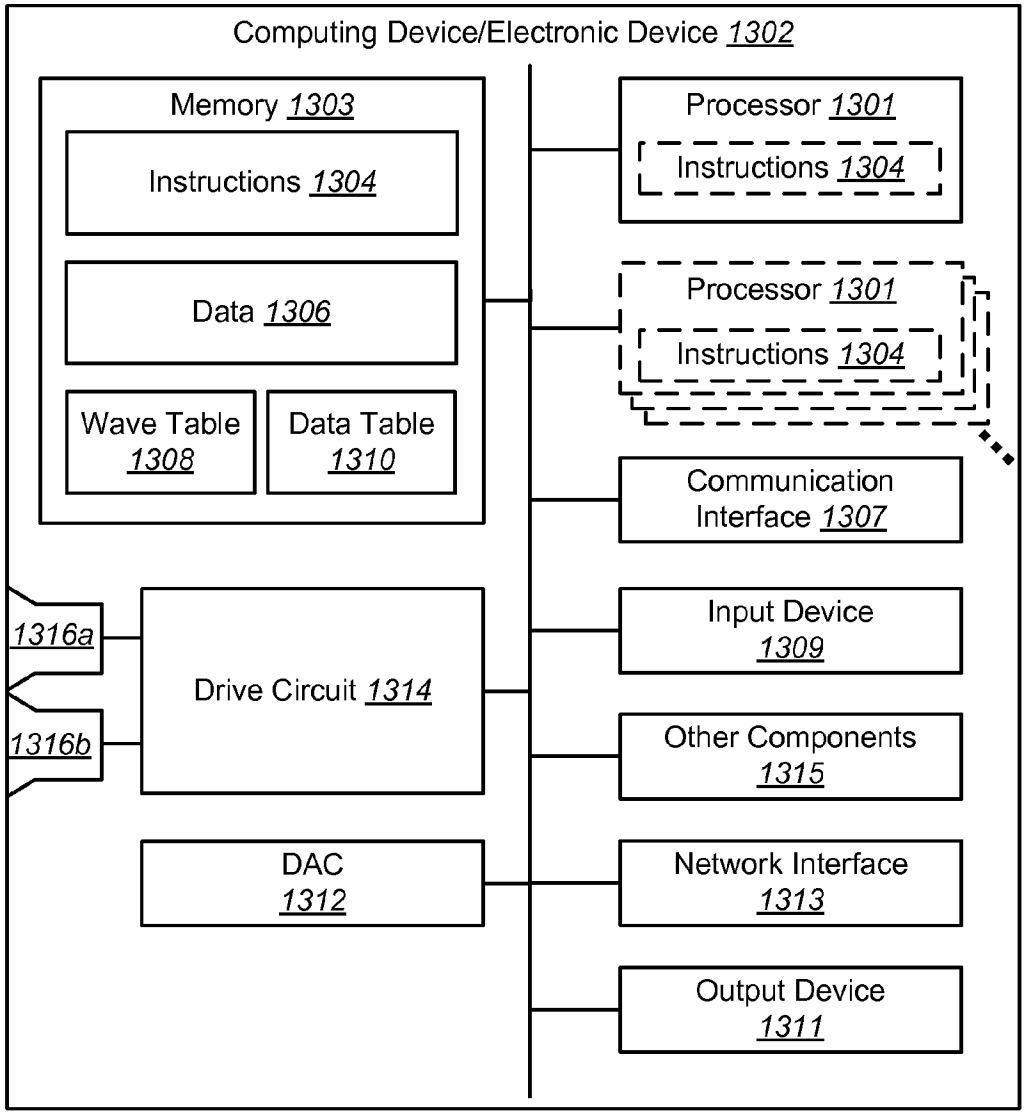
FIG. 13 is a block diagram illustrating various components that may be utilized in a computing device/electronic device.

FIG. 13 is a block diagram illustrating various components that may be utilized in a computing device/electronic device 1302. The computing device/electronic device 1302 may implement any device capable of processing music files 310, e.g., a velocity translator, an unknown player 304, or a known player 308. Thus, although only one computing device/electronic device 1302 is shown, the configurations herein may be implemented in a distributed system using many computer systems. Computing devices/electronic devices 1302 may include the broad range of digital computers including microcontrollers, hand-held computers, personal computers, servers, mainframes, supercomputers, minicomputers, workstations, and any variation or related device thereof.

The computing device/electronic device 1302 is shown with a processor 1301 and memory 1303. The processor 1301 may control the operation of the computing device/electronic device 1302 and may be embodied as a microprocessor, a microcontroller, a digital signal processor (DSP) or other device known in the art. The processor 1301 typically performs logical and arithmetic operations based on program instructions 1304 stored within the memory 1303. The instructions 1304 in the memory 1303 may be executable to implement the methods described herein.

The computing device/electronic device 1302 may also include one or more communication interfaces 1307 and/or network interfaces 1313 for communicating with other electronic devices. The communication interface(s) 1307 and the network interface(s) 1313 may be based on wired communication technology, wireless communication technology, or both.

The computing device/electronic device 1302 may also include one or more input devices 1309 and one or more output devices 1311. The input devices 1309 and output devices 1311 may facilitate user input. Other components 1315 may also be provided as part of the computing device/electronic device 1302.

Data 1306 and instructions 1304 may be stored in the memory 1303. The processor 1301 may load and execute instructions 1304 from the memory 1303 to implement various functions. Executing the instructions 1304 may involve the use of the data 1306 that is stored in the memory 1303. The instructions 1304 are executable to implement one or more of the processes or configurations shown herein, and the data 1306 may include one or more of the various pieces of data described herein.

The memory 1303 may be any electronic component capable of storing electronic information. The memory 1303 may be embodied as random access memory (RAM), read only memory (ROM), magnetic disk storage media, optical storage media, flash memory devices in RAM, on-board memory included with the processor, EPROM memory, EEPROM memory, an ASIC (Application Specific Integrated Circuit), registers, and so forth, including combinations thereof.

Additionally, the memory 1303 may store a wave table 1308 that includes base waveforms for the general MIDI instruments. The memory 1303 may also store a data table 1310 that includes comparison data and mapping table required to convert into audio device specific format. For example, where the wave table 1308 may include 128 instruments and 47 drums, the data table 1310 may include 128 plus 47 sets of comparison data and required mapping table to compensate for volume changes, etc.

The data 1306 stored in the data table 1310 may be generated and loaded into the data table 1310 when the computing device/electronic device 1302 is initially produced. Alternatively, the data table 1310 may be loaded by way of a software update downloaded to an existing computing device/electronic device 1302.

Alternatively, or in addition, there may be more than one processor 1301, which may operate in parallel to load and execute instructions 1304. These instructions 1304 may include parsing music files 310 and scheduling MIDI events or messages within the music files 310. The scheduled MIDI events may be serviced by the processor 1301 in a synchronized manner, as specified by timing parameters in the music files 310. The processor 1301 may process the MIDI events according to the time-synchronized schedule in order to generate MIDI synthesis parameters. The processor 1301 may also generate audio samples based on the synthesis parameters.

The computing device/electronic device 1302 may also include a digital-to-analog converter (DAC) 1312. The processor 1301 may generate audio samples based on a set of MIDI synthesis parameters. The audio samples may comprise pulse-code modulation (PCM) samples, which may be digital representations of an analog signal that is sampled at regular intervals. The processor 1301 may output the audio samples to the DAC 1312. The DAC 1312 may then convert the digital audio signals into an analog signal and outputs the analog signal to a drive circuit 1314, which may amplify the signal to drive one or more speakers 1316 to create audible sound. Alternatively, the computing device/electronic device 1302 may not have speakers 1316, the drive circuit 1314, or the DAC 1312.

When the computing device/electronic device 1302 receives a music file 310, the processor 1301 may parse the music file 310 and detect whether there are any downloadable sounds (DLS). The computing device/electronic device 1302 may wait to receive all of the frames associated with the music file 310 before analyzing any downloadable sound within the music file 310. If no downloadable sounds are detected within the music file 310, the processor 1301 may process the MIDI data within the music file 310 and may convert some or all of the MIDI commands, however, the processor 1301 may be limited. For example, the processor 1301 may not convert multi-region instruments or user defined root notes correctly.

When a downloadable sound is detected, however, the processor 1301 may analyze the downloadable sound (DLS) data by comparing the parameters of the DLS data with the device limitation on parameters and internal player details. Based on this analysis, the processor 1301 may then map one or more of the instruments to play into device specific parameters. The processor 1301 may also modify the corresponding music file 310. In particular, the processor 1301 may select a waveform sample corresponding to the selected instrument from the wave table 1308. The computing device/electronic device 1302 may then proceed by generating audio samples and sending the audio samples to the DAC 1312. The output of the DAC 1312 may go to the drive circuit 1314 and ultimately to the speakers 1316 to play audible sound. In this manner, the computing device/electronic device 1302 may select an instrument that will best approximate the sound of the downloadable sound, so that the MIDI events/notes sound as close as possible to the sound intended by the author.

In the above description, reference numbers have sometimes been used in connection with various terms. Where a term is used in connection with a reference number, this is meant to refer to a specific element that is shown in one or more of the Figures. Where a term is used without a reference number, this is meant to refer generally to the term without limitation to any particular Figure.

In accordance with the present disclosure, a circuit in a mobile device may be adapted to receive signal conversion commands and accompanying data in relation to multiple types of compressed audio bitstreams. The same circuit, a different circuit, or a second section of the same or different circuit may be adapted to perform a transform as part of signal conversion for the multiple types of compressed audio bitstreams. The second section may advantageously be coupled to the first section, or it may be embodied in the same circuit as the first section. In addition, the same circuit, a different circuit, or a third section of the same or different circuit may be adapted to perform complementary processing as part of the signal conversion for the multiple types of compressed audio bitstreams. The third section may advantageously be coupled to the first and second sections, or it may be embodied in the same circuit as the first and second sections. In addition, the same circuit, a different circuit, or a fourth section of the same or different circuit may be adapted to control the configuration of the circuit(s) or section(s) of circuit(s) that provide the functionality described above.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The term "processor" should be interpreted broadly to encompass a general purpose processor, a central processing unit (CPU), a microprocessor, a digital signal processor (DSP), a controller, a microcontroller, a state machine, and so forth. Under some circumstances, a "processor" may refer to an application specific integrated circuit (ASIC), a programmable logic device (PLD), a field programmable gate array (FPGA), etc. The term "processor" may refer to a combination of processing devices, e.g., a combination of a DSP and a microprocessor, a plurality of microprocessors, one or more microprocessors in conjunction with a DSP core, or any other such configuration.

The term "memory" should be interpreted broadly to encompass any electronic component capable of storing electronic information. The term memory may refer to various types of processor-readable media such as random access memory (RAM), read-only memory (ROM), non-volatile random access memory (NVRAM), programmable read-only memory (PROM), erasable programmable read only memory (EPROM), electrically erasable PROM (EEPROM), flash memory, magnetic or optical data storage, registers, etc. Memory is said to be in electronic communication with a processor if the processor can read information from and/or write information to the memory. Memory that is integral to a processor is in electronic communication with the processor.

The terms "instructions" and "code" should be interpreted broadly to include any type of computer-readable statement (s). For example, the terms "instructions" and "code" may refer to one or more programs, routines, sub-routines, functions, procedures, etc. "Instructions" and "code" may comprise a single computer-readable statement or many computer-readable statements.

The functions described herein may be implemented in hardware, software, firmware, or any combination thereof. If implemented in software, the functions may be stored as one or more instructions on a computer-readable medium. The term "computer-readable medium" refers to any available medium that can be accessed by a computer. By way of example, and not limitation, a computer-readable medium may comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

Further, it should be appreciated that modules and/or other appropriate means for performing the methods and techniques described herein, such as those illustrated by FIGS. 7, 10 and 12, can be downloaded and/or otherwise obtained by a device. For example, a device may be coupled to a server to facilitate the transfer of means for performing the methods described herein. Alternatively, various methods described herein can be provided via a storage means (e.g., random access memory (RAM), read only memory (ROM), a physical storage medium such as a compact disc (CD) or floppy disk, etc.), such that a device may obtain the various methods upon coupling or providing the storage means to the device. Moreover, any other suitable technique for providing the methods and techniques described herein to a device can be utilized.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for providing multi-region instrument support in an audio player, comprising:

receiving a set of user defined instruments and a set of Musical Instrument Digital Interface (MIDI) data;

identifying at least one multi-region instrument in the set of user defined instruments;

mapping each region in the at least one multi-region instrument to a new single region instrument with the same parameters as the respective region to produce a plurality of new single region instruments;

assigning a single new instrument number to each new single region instrument;

modifying the MIDI data based on the mapping and assigning; and playing the modified MIDI data on an unknown player that is not compatible with the at least one pre-mapped multi-region instrument.

2. The method of claim 1, wherein the modifying comprises inserting one or more program change commands into the MIDI data before any MIDI messages using multi-region instruments.

3. The method of claim 1, further comprising combining the new single region instruments and the modified MIDI data into a player specific format.

4. The method of claim 3, wherein the player specific format comprises a Synthetic music Mobile Application Format (SMAF) file.

5. The method of claim 1, wherein the set of user defined instruments is a Downloadable Sounds (DLS) file.

6. The method of claim 1, wherein the receiving further comprises receiving an Extensible Music Format (XMF) file.

7. The method of claim 1, wherein the new instrument numbers overlap with multi-region instrument numbers.

8. The method of claim 1, wherein the assigning further comprises creating a new bank of instruments when there are no available instrument numbers in a current bank.

9. The method of claim 8, wherein the modifying comprises inserting one or more bank change commands before any MIDI message in the MIDI data using a multi-region instrument that was mapped to the new bank of instruments.

10. The method of claim 1, further comprising searching the MIDI data for MIDI messages using multi-region instruments.

11. An apparatus for providing multi-region instrument support in an audio player, comprising:

a processor;

memory in electronic communication with the processor;

instructions stored in the memory, the instructions being executable by the processor to:

receive a set of user defined instruments and a set of Musical Instrument Digital Interface (MIDI) data;

identify at least one multi-region instrument in the set of user defined instruments;

map each region in the at least one multi-region instrument to a new single region instrument with the same parameters as the respective region to produce a plurality of new single region instruments;

assign a single new instrument number to each new single region instrument;

modify the MIDI data based on the mapping and assigning; and play the modified MIDI data on an unknown player that is not compatible with the at least one pre-mapped multi-region instrument.

12. The apparatus of claim 11, wherein the modifying comprises inserting one or more program change commands into the MIDI data before any MIDI messages using multi-region instruments.

13. The apparatus of claim 11, wherein the instructions are further executable to combine the new single region instruments and the modified MIDI data into a player specific format.

14. The apparatus of claim 13, wherein the player specific format comprises a Synthetic music Mobile Application Format (SMAF) file.

15. The apparatus of claim 11, wherein the set of user defined instruments is a Downloadable Sounds (DLS) file.

16. The apparatus of claim 11, wherein the receiving further comprises receiving an Extensible Music Format (XMF) file.

17. The apparatus of claim 11, wherein the new instrument numbers overlap with multi-region instrument numbers.

18. The apparatus of claim 11, wherein the assigning further comprises creating a new bank of instruments when there are no available instrument numbers in a current bank.

19. The apparatus of claim 18, wherein the modifying comprises inserting one or more bank change commands before any MIDI message in the MIDI data using a multi-region instrument that was mapped to the new bank of instruments.

20. The apparatus of claim 11, wherein the instructions are further executable to search the MIDI data for MIDI messages using multi-region instruments.

21. A computer-program product for providing multi-region instrument support in an audio player, the computer-program product comprising a computer-readable medium having instructions thereon, the instructions comprising:

code for receiving a set of user defined instruments and a set of Musical Instrument Digital (MIDI) data;

code for identifying at least one multi-region instrument in the set of user defined instruments;

code for mapping each region in the at least one multi-region instrument to a new single region instrument with the same parameters as the respective region to produce a plurality of new single region instruments;

code for assigning a single new instrument number to each new single region instrument;

code for modifying the MIDI data based on the mapping and assigning; and code for playing the modified MIDI data on an unknown player that is not compatible with the at least one pre-mapped multi-region instrument.

22. The computer-program product of claim 21, wherein the code for modifying comprises code for inserting one or more program change commands into the MIDI data before any MIDI messages using multi-region instruments.

23. The computer-program product of claim 21, wherein the instructions further comprise code for combining the new single region instruments and the modified MIDI data into a player specific format.

24. The computer-program product of claim 21, wherein the set of user defined instruments is a Downloadable Sounds (DLS) file.

25. The computer-program product of claim 21, wherein the code for receiving further comprises code for receiving an Extensible Music Format (XMF) file.

26. An apparatus for providing multi-region instrument support in an audio player, comprising:

means for receiving a set of user defined instruments and a set of Musical Instrument Digital Interface (MIDI) data;

means for identifying at least one multi-region instrument in the set of user defined instruments;

means for mapping each region in the at least one multi-region instrument to a new single region instrument with the same parameters as the respective region to produce a plurality of new single region instruments;

means for assigning a single new instrument number to each new single region instrument;

means for modifying the MIDI data based on the mapping and assigning; and means for playing the modified MIDI data on an unknown player that is not compatible with the at least one pre-mapped multi-region instrument.

27. The apparatus of claim 26, wherein the means for modifying further comprises means for inserting one or more program change commands into the MIDI data before any MIDI messages using multi-region instruments.

28. The apparatus of claim 26, further comprising means for combining the new single region instruments and the modified MIDI data into a player specific format.

29. The apparatus of claim 26, wherein the set of user defined instruments is a Downloadable Sounds (DLS) file.

30. The apparatus of claim 26, wherein the means for receiving further comprises means for receiving an Extensible Music Format (XMF) file.

31. An integrated circuit for providing multi-region instrument support in an audio player, the integrated circuit being configured to:

receive a set of user defined instruments and a set of Musical Instrument Digital Interface (MIDI) data;

identify at least one multi-region instrument in the set of user defined instruments;

map each region in the at least one multi-region instrument to a new single region instrument with the same parameters as the respective region to produce a plurality of new single region instruments;

assign a single new instrument number to each new single region instrument;

modify the MIDI data based on the mapping and assigning; and play the modified MIDI data on an unknown player that is not compatible with the at least one pre-mapped multi-region instrument.

32. The integrated circuit of claim 31, wherein modifying the Musical Instrument Digital Interface (MIDI) data comprises inserting one or more program change commands into the MIDI data before any MIDI messages using multi-region instruments.

33. The integrated circuit of claim 31, wherein the integrated circuit is further configured to combine the new single region instruments and the modified Musical Instrument Digital Interface (MIDI) data into a player specific format.

* * * * *